US010543145B1

(12) United States Patent
McGuire

(10) Patent No.: US 10,543,145 B1
(45) Date of Patent: Jan. 28, 2020

(54) ADJUSTABLE SLIP RESISTANT WALKING SURFACE FOR USE WITH A MOBILITY AID

(71) Applicant: Daniel J. McGuire, Trumbull, CT (US)

(72) Inventor: Daniel J. McGuire, Trumbull, CT (US)

( * ) Notice: Subject to any disclaimer, the term of this patent is extended or adjusted under 35 U.S.C. 154(b) by 0 days.

(21) Appl. No.: 16/207,432

(22) Filed: Dec. 3, 2018

Related U.S. Application Data

(63) Continuation-in-part of application No. 15/627,728, filed on Jun. 20, 2017, now Pat. No. 10,166,165, which is a continuation-in-part of application No. 14/697,472, filed on Apr. 27, 2015, now Pat. No. 9,707,148.

(60) Provisional application No. 61/986,772, filed on Apr. 30, 2014.

(51) Int. Cl.

| | |
|---|---|
| ***A61H 3/04*** | (2006.01) |
| ***A61G 5/00*** | (2006.01) |
| ***A61H 3/00*** | (2006.01) |
| ***A61G 7/10*** | (2006.01) |
| *A45B 9/00* | (2006.01) |

(52) U.S. Cl.
CPC ..... *A61H 3/04* (2013.01); *A61G 5/00* (2013.01); *A61G 7/10* (2013.01); *A61H 3/00* (2013.01); *A45B 2009/002* (2013.01); *A61H 2003/005* (2013.01)

(58) Field of Classification Search
CPC . A61H 3/04; A61H 3/00; A61H 3/008; A61H 2003/005; A61H 2201/164; A61G 7/10; A61G 7/053; A61G 5/14
USPC ..... 135/66–67, 85; 482/66–68, 75–76, 80; 297/423.1, 423.18, 423.25, 423.27, 297/423.34–423.36; 5/81.1 R, 83.1, 88.1, 5/86.1, 89.1, 81.1 HS, 662
See application file for complete search history.

(56) References Cited

U.S. PATENT DOCUMENTS

| | | | | |
|---|---|---|---|---|
| 2,548,098 A * | 4/1951 | Clarin | A47C 11/02 297/30 |
| 3,272,530 A * | 9/1966 | Klassen | A61G 7/1038 280/79.2 |
| 3,591,874 A * | 7/1971 | O'Kennedy | A61G 7/1038 5/171 |
| 4,111,445 A * | 9/1978 | Haibeck | A61G 7/1038 280/79.3 |
| 4,165,127 A | 8/1979 | Vago | 297/345 |
| 4,266,305 A | 5/1981 | Kavaloski et al. | 4/480 |

(Continued)

FOREIGN PATENT DOCUMENTS

WO WO 2005/120423 12/2005

*Primary Examiner* — Winnie Yip
(74) *Attorney, Agent, or Firm* — Fattibene and Fattibene LLC; Paul A. Fattibene

(57) ABSTRACT

An attachment to a mobility aid, such as a walker, wheeled walker or rollator, or wheelchair that automatically positions a slip resistant surface under the foot of the user. The distance the slip resistant surface is from the mobility aid is adjustable to suit the user. A retractable slip resistant surface attachment is removably attached to sides of the mobility aid. A sliding channel bracket is slidably attached to an attachment panel permitting the sliding channel bracket to be adjusted longitudinally. A slide panel with slide members captured by the sliding channel bracket permits an attached slip resist surface to move freely back and forth with a retraction mechanism. Adjustable, secure footing is obtained on wet or slippery surfaces preventing falls.

10 Claims, 23 Drawing Sheets

(56) References Cited

U.S. PATENT DOCUMENTS

| | | | | | |
|---|---|---|---|---|---|
| 4,314,576 | A | | 2/1982 | McGee | 135/67 |
| 4,843,661 | A | | 7/1989 | Skibinski | 5/81 R |
| 5,080,083 | A | | 1/1992 | Hsieh | 280/87.051 |
| 5,118,130 | A | | 6/1992 | Kaltz | 280/154 |
| 5,148,559 | A | | 9/1992 | Morris | 5/86.1 |
| 5,365,621 | A | * | 11/1994 | Blain | A61G 7/1017 5/83.1 |
| 5,411,044 | A | | 5/1995 | Andolfi | 135/66 |
| 5,517,704 | A | * | 5/1996 | Dagostino | A47K 3/122 4/480 |
| 5,538,489 | A | | 7/1996 | Magid | 482/54 |
| 5,662,131 | A | | 9/1997 | Scarborough | 135/65 |
| 5,794,284 | A | | 8/1998 | Southwell | 135/67 |
| 5,950,258 | A | * | 9/1999 | Deyne | A61G 7/10 135/66 |
| 6,443,252 | B1 | * | 9/2002 | Andes | A61G 5/10 180/65.1 |
| 6,651,993 | B1 | | 11/2003 | Emerizian | 280/47.17 |
| 6,860,281 | B1 | | 3/2005 | Clift | 135/67 |
| 7,455,362 | B2 | * | 11/2008 | Hanson | A61G 5/10 297/320 |
| 7,779,581 | B2 | | 8/2010 | Flaherty et al. | 52/177 |
| 7,871,088 | B2 | | 1/2011 | Silvia et al. | 280/33.998 |
| 8,146,713 | B2 | * | 4/2012 | Rosenthal | B66B 9/083 187/200 |
| 8,794,252 | B2 | | 8/2014 | Alghazi | 135/66 |
| 2004/0021300 | A1 | | 2/2004 | Tsai | 280/642 |
| 2008/0004163 | A1 | | 1/2008 | Husted | 482/57 |
| 2012/0023661 | A1 | * | 2/2012 | Ota | A61G 7/1017 5/86.1 |
| 2013/0292988 | A1 | | 11/2013 | Jeyasurya et al. | 297/423.26 |
| 2013/0328374 | A1 | | 12/2013 | Priest | 297/411.2 |

* cited by examiner

ADJUSTABLE SLIP RESISTANT WALKING SURFACE FOR USE WITH A MOBILITY AID

RELATED APPLICATIONS

This application is a continuation-in-part of U.S. patent application Ser. No. 15/627,728 filed Jun. 20, 2017 which is a continuation-in-part of U.S. application Ser. No. 14/697,472 filed Apr. 27, 2015 which claims the benefit of U.S. Provisional Application No. 61/986,772 filed Apr. 30, 2014, all of which are herein incorporated by reference.

FIELD OF THE INVENTION

The present invention relates in general to assisting individuals in their mobility and walking, and particularly to providing secure footing for individuals using mobility aids, such as walkers, rolling walkers or rollators, and wheelchairs on slippery surfaces.

BACKGROUND OF THE INVENTION

Walking or mobility aids are used by many people. Many elderly people use canes or walkers to provide needed stability and to prevent falling. Walkers have been developed that have four wheels and even provide the convenience of a seat and brakes. The walkers often fold for easy transport and to be readily available when needed. Walkers have greatly facilitated the mobility of many individuals, but they are often of little help in slippery conditions. For example on wet, snowy, or icy surfaces a walker provides no help in preventing a person's foot from slipping and causing a fall. Similar problems are encountered when using a wheelchair. The person pushing a wheel chair often needs to walk on a slipper surface. Therefore, there is a need for a device that can easily be use with a mobility aid, such as a walker, rolling walker or rollator, or wheelchair and that assures that the user has secure footing always under their feet as the mobility aid is moved and the user steps forward.

SUMMARY OF THE INVENTION

The present invention provides an attachment to a mobility aid, inducing a conventional or standard walker that provides a slip resistant surface that is automatically positioned under the user's foot as the walker is advanced or moved forward. Movable slip resistant surfaces are attached to support bars which are removably attached to a frame of a walker. The slip resistant surfaces are attached to a retraction means for selectively pulling the slip resistant surfaces towards the walker when the pressure of a user's foot is removed. As the user moves the walker forward the slip resistant surfaces are alternately moved into position under the user's foot by the retraction means for selectively pulling the slip resistant surface towards the walker. The attachment can be folded and closed to be positioned out of the way on the walker or removed and stored until needed.

In another embodiment of the present invention a modular system is used permitting attachment to a variety of different mobility aids, such as a walker, rolling walker or rollator, or wheelchair. An attachment bracket is attached on opposing sides of the mobility aid. A retractable slip resistant surface and cleat assembly is removably attached to each of the attachment brackets. The attachment brackets may have an intermediate pivot to facilitate folding with the mobility aid when the mobility aid is folded or collapsed.

In yet another embodiment of the present invention a retractable slip resistant surface attachment comprising an attachment panel with a sliding channel bracket holding a slide panel with attached slide wheels. The sliding channel bracket is selectively positioned longitudinally along the attachment panel. This permits the slip resistant surface to be moved backward and forward closer to and further away from the mobility aid so as to accommodate the stride of the user.

It is an object of the present invention to provide secure footing for a user of a walker on slippery surfaces, such as when walking in wet, icy, or snowy conditions.

It is another object of the present invention that is easy to use and attach to a walker.

It is an advantage of the present invention that it can be attached to an existing walker without the need to modify the walker.

It is another advantage of the present invention that it can be easily folded to be positioned out of the way on the walker when not in use.

Is a feature of the present invention that a retractable cord automatically positions a slip resistant surface under a user's foot.

It is another feature of the present invention that the slip resistant surfaces move independently from one another.

It is another feature of the present invention that the retractable cord can be selectively detached from the slip resistant surface permitting the slip resistant surface to be folded and closed to be compactly stored.

It is an object of an embodiment of the present invention to provide a modular or universal attachment system adapted to attach to a variety of mobility aids for receiving a retractable slip resistant surface and cleat assembly.

It is an advantage of an embodiment of the present invention that an attachment bracket may remain on the mobility aid with the retractable slip resistant surface and cleat assembly easily installed or removed as desired.

It is a feature of an embodiment of the present invention that the retractable slip resistant surface and cleat assembly slides in place and locks into an attachment bracket attached to the mobility aid.

It is another feature of an embodiment of the present invention that the attachment bracket has an intermediate pivot permitting it to fold with the folding or collapsing of the mobility aid.

It is an object of another embodiment of the present invention that the retractable slip resistant surface and cleat assembly can provide secure footing for a user.

It is an advantage of another embodiment of the present invention that the retractable slip resistant surface and cleat assembly can selectively slide along or grip the ground.

It is a feature of another embodiment of the present invention that the cleats are engaged with the ground when a user steps on the retractable slip resistant surface and disengaged with the ground when a user raises their foot.

It is an object of yet another embodiment of the present invention to provide adjustability to accommodate a user.

It is an advantage of yet another embodiment of the present invention that it can easily be attached to the mobility aid in both a use and storage position.

It is a feature of yet another embodiment of the present invention that the slip resistant surface is selectively positioned longitudinally relative to the mobility aid.

These and other objects, advantages, and features will become more readily apparent in view of the following more detailed discussion.

DETAILED DESCRIPTION OF THE INVENTION

A walker, is generally used for individuals that may have difficulty walking and require some additional support to prevent falling. The present invention provides secure footing and improved stability for an individual using a walker on a slippery surface. At times, a walker may need to be used on surfaces that are wet, icy, slippery or uneven. When a walker is used in conditions where the walking surface may be slippery, such as when the walking surface is wet or icy, an individual having to step directly on the slippery surface may be much more prone to slipping or falling despite the use of the walker. The present invention provides a solution to the problem of using a walker on a slippery surface.

Figure 1:
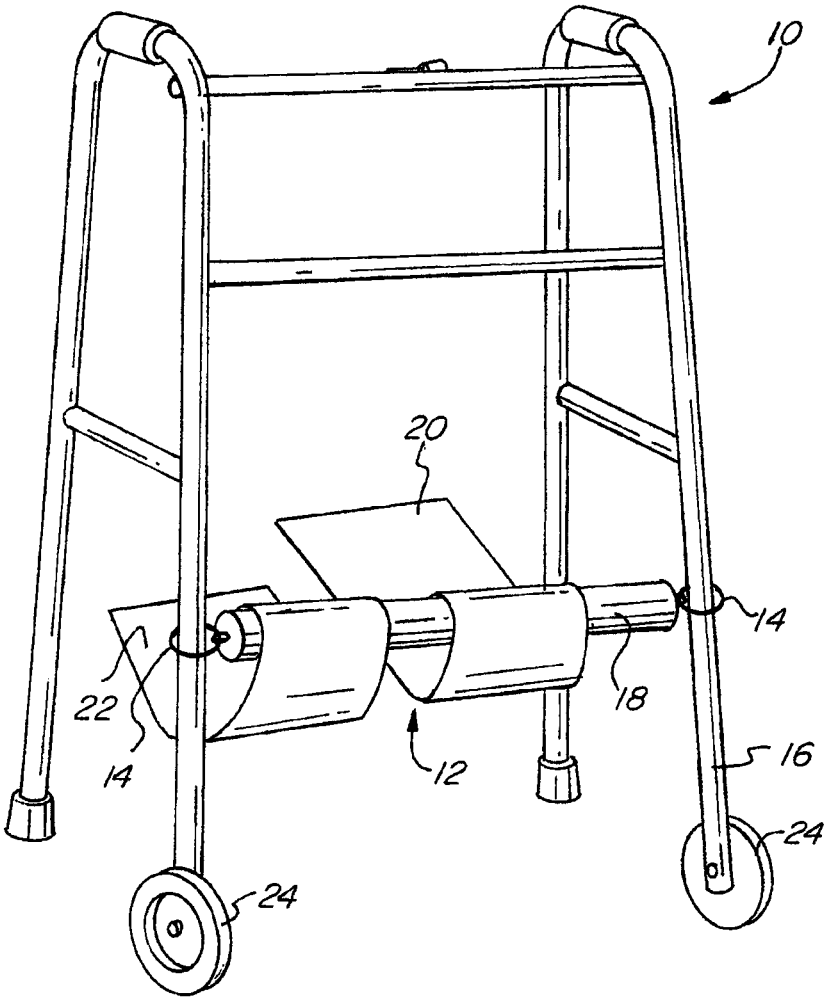
FIG. 1 schematically illustrates an embodiment of the present invention.

FIG. 1 schematically illustrates the present invention attached to a walker 10. A slip resistant surface attachment 12 is attached to a leg 16 of the walker 10 with an attachment clip or means for attaching 14. The attachment 12 comprises a roller or cylinder 18 and a slip resistant surface or pad 20 and 22. The walker 10 may have wheels 24.

The attachment 12 is securely connected to the walker 10 by the attachment clips 14 and may be easily removed and stored when not needed. Preferably, there are two slip resistant surfaces 20, 22 that move independently corresponding to each foot of the user. The slip resistant surfaces 20, 22 are rolled up on the roller or cylinder 18. An internal spring may be used with a ratcheting mechanism, such as used in a common window shade, to extend and retract the slip resistant surfaces 20, 22. Additionally, the roller or cylinder 18 may be bifurcated or made up of two individual rollers or cylinders that rotate independently so that the two slip resistant surfaces 20, 22 may be moved independently following the movement of each of the user's feet.

The present invention provides a device that greatly improves the stability of a user using a walker on a wet, slippery, or icy surface. The present invention assures that a user is always walking on a slip resistant surface. Means may be used for adjusting the tension or force in which the slip resistant surface is extended or retracted. The slip resistant surface may also be rolled up and detached from the walker for convenient storage when not needed. A knob may be used to assist rolling up the slip resistant surface onto the roller or cylinder. A locking device may also be used to prevent movement of the slip resistant surface from rolling and unrolling on the roller or cylinder.

Figure 2:
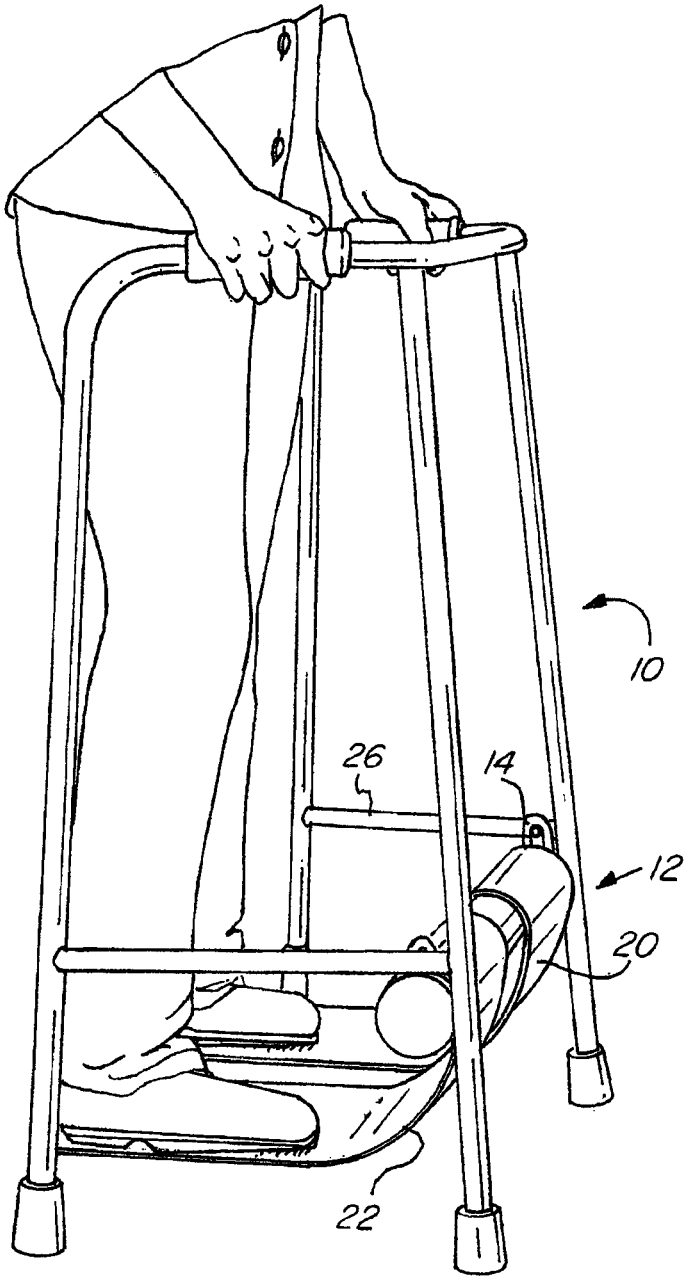
FIG. 2 illustrates use of a walker by a user with the present invention attached.

FIG. 2 more clearly illustrates use of the present invention by a user and the placement of a user's foot on one of the slip resistant surfaces 22. In FIG. 2, the slip resistant surface attachment 12 is attached to a horizontal bar 26 of the walker with the attachment clip or means for attaching 14. As the user walks and placing their foot on one of the slip resistant surfaces 20 and 22, and advances the walker forward the slip resistant surfaces 20 and 22 will extend and retract following the user's feet. This may be accomplished by a bias spring and a ratchet mechanism incorporated within the roller 18 such that when pressure by the user's foot is applied to the slip resistant surface 20 or 22, it will extend and when pressure is released by movement of the user's foot it will retract a predetermined distance to become positioned for the user's next step.

Figure 3:
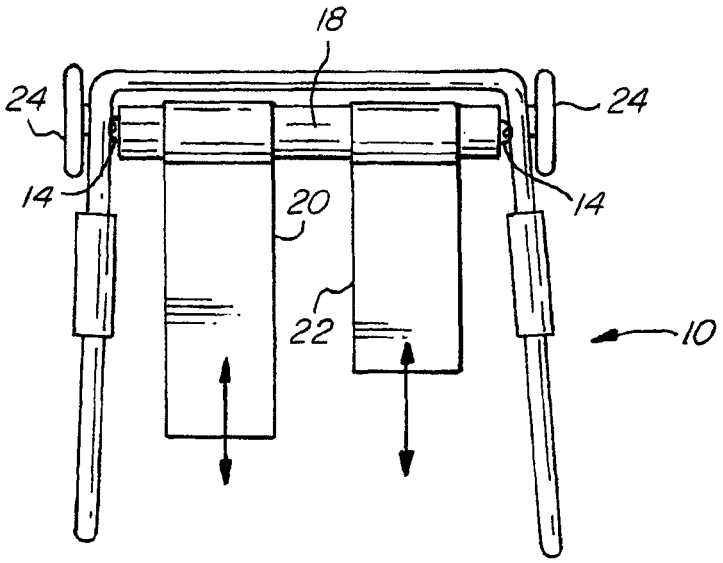
FIG. 3 is a plan view illustrating the present invention.

FIG. 3 is a plan view illustrating the walker 10 with the attachment 12 attached thereto. FIG. 3 illustrates the different amount of retraction and extension of the slip resistant surfaces 20 and 22. The movement of the slip resistant surfaces 20 and 22 are represented by the arrows.

Figure 4:
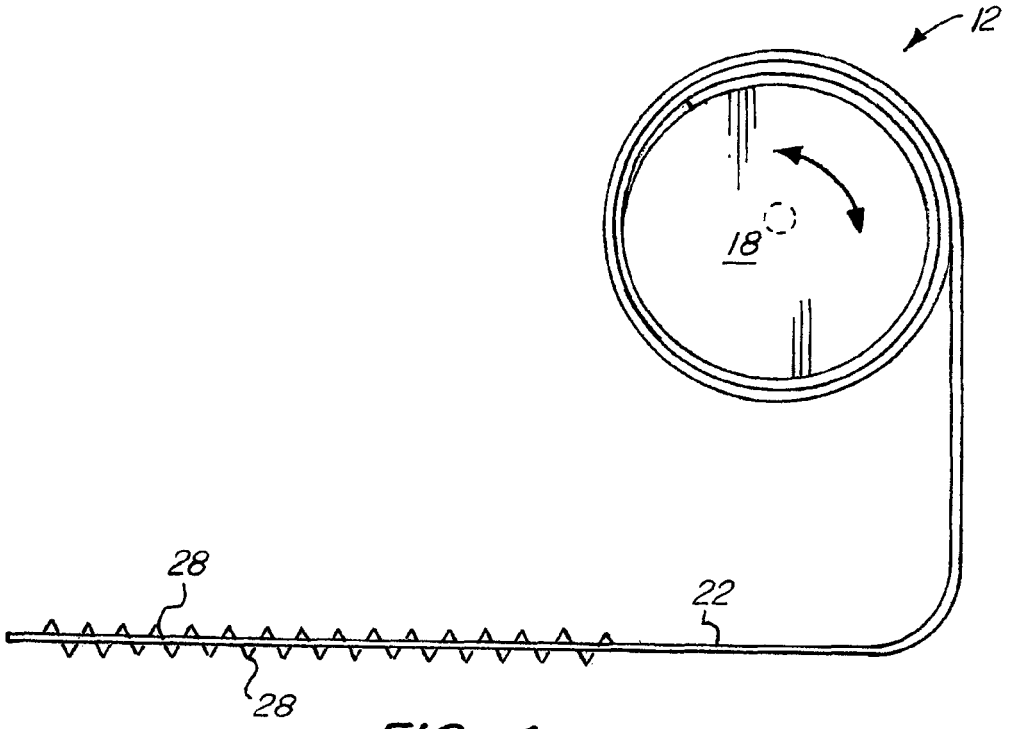
FIG. 4 is a side elevational view illustrating the present invention.

FIG. 4 is a side elevational view illustrating the slip resistant surface 22 rolled up on the roller or cylinder 18 in the direction of the arrow placed thereon. FIG. 4 also illustrates an embodiment that has cleats 28 placed on the slip resistant surface 22 on either the top or bottom surface or both. Any form or shape of cleat 28 may be used.

Additionally, the slip resistant surface maybe made of rubber, plastic, fabric or any flexible material that provides a slip resistant surface and that is capable of being rolled.

Figure 5:
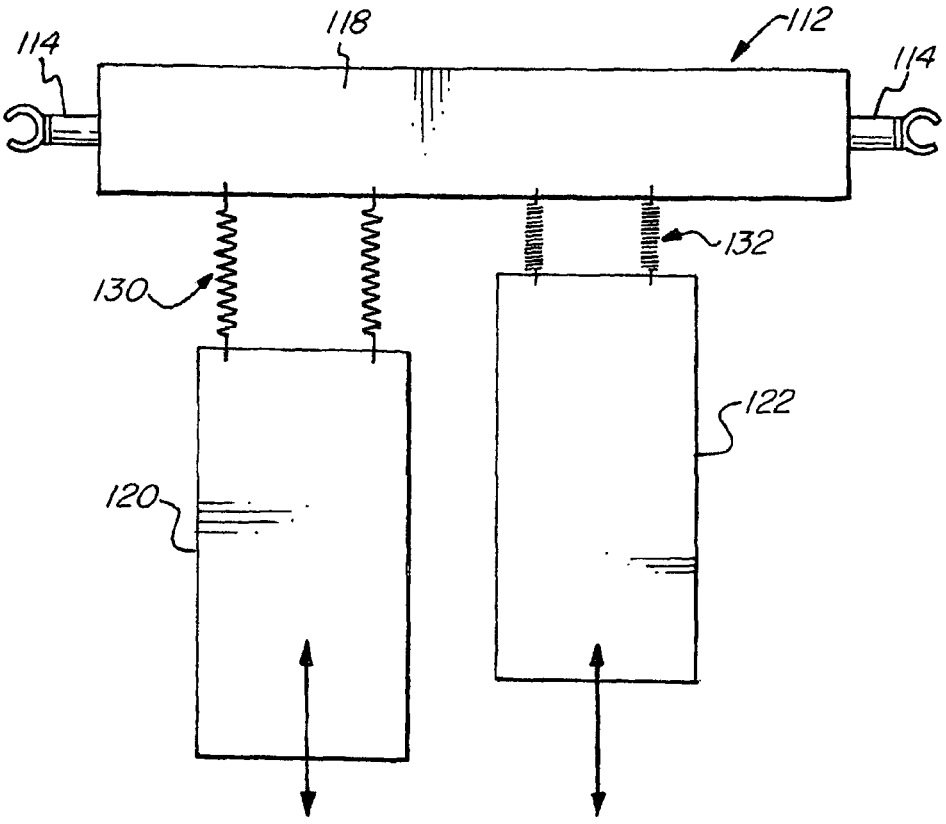
FIG. 5 is a plan view illustrating another embodiment of the present invention.
Figure 6:
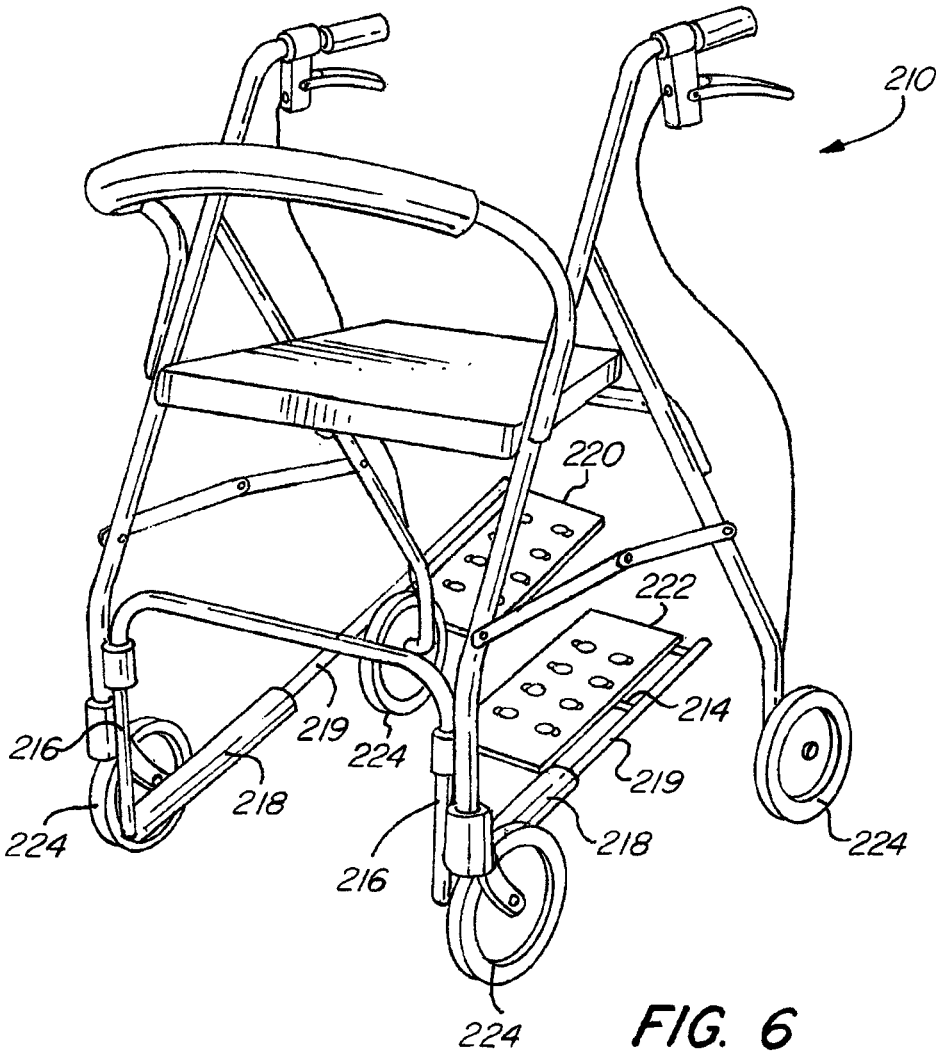
FIG. 6 is a perspective view schematically illustrating another embodiment of the present invention.

FIG. 5 illustrates another embodiment of the present invention utilizing a spring or other equivalent means for retracting and extending or moving the slip resistant surfaces 120 and 122. In this embodiment the slip resistant surface attachment 112 comprises a bar or cylinder 118 having attachment clips 114 placed on either end. Attached to the bar 118 intermediate the ends thereof are spring means for extending and retracting the slip resistant surfaces 120 and 122 and permitting them to move in the direction of the arrows. Accordingly, when the user's foot applies pressure to one of the slip resistant surfaces 120 and 122, the slip resistant surface 120 or 122 will extend biasing the spring means 130 or 132. When the user's foot is raised for taking a step pressure is released from the slip resistant surface 120 or 122 and the spring means 130 or 132 causes the slip resistant surface 120 or 122 to retract or move forward placing it in position for the user's next step. In this way it is assured that the user will always have a slip resistant surface under their feet when walking forward.

FIGS. 6-9 illustrate another embodiment of the present invention. This embodiment of the invention has been adapted to a walker 210 having four wheels 224. The four wheeled walker 210 has a frame with an attached cylinder support 216 adjacent each front wheel 224. Cylinders 218 are attached to the cylinder support adjacent the two front wheels 224. The cylinders 218 may be attached by other means. Cylinders 218 each contain a piston and spring. The piston is attached to a piston rod 219. A piston rod 219 is attached to a first slip resistant surface 220 and the other piston rod 219 is attached to a second slip resistant surface 222. That is, the first and second slip resistant surfaces 220 and 222 are attached to a respective one of the piston rods 219. The piston rods 219 are biased by a spring so as to position the first and second slip resistant surfaces 220 and 222 underneath the frame of the walker 210. Upon a person stepping onto one of the first or second slip resistant surfaces 220 or 222 and the walker is moved forward the piston rod 219 will be extended rearward compressing a spring within the cylinder 218. Upon removing one's foot from either the first or second slip resistant surfaces 220 or 222 the spring bias will cause of the slip resistant surface 220 or 222 to retract under the frame of the walker 210 and to be reset in a position for a person to take another step. Therefore, one of the first or second slip resistant surfaces 220 or 222 will always be in position to be stepped upon by the person as the person walks forward with the walker 210. The slip resistant surfaces 220 and 222 are attached to the piston rod 219 with an attachment clip or bracket 214. The attachment clip or bracket 214 may comprise a pivot so that the slip resistant surfaces 220 and 222 may be rotated vertically 90° to be positioned out of the way when not intended to be used.

Figure 7:
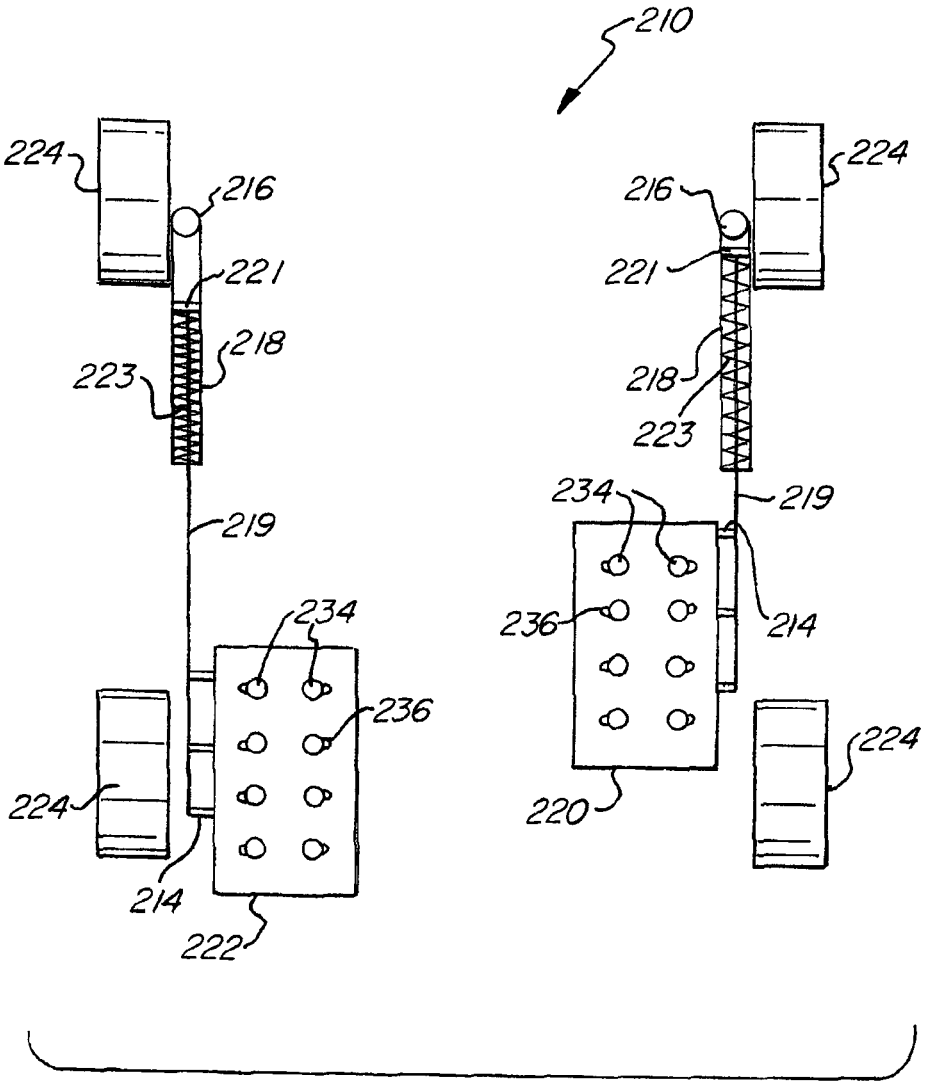
FIG. 7 is a plan view schematically illustrating the embodiment illustrated in FIG. 6.

FIG. 7 is a plan view schematically illustrating the operation of this embodiment of the present invention. Adjacent the front wheels 224 of the walker 210 are cylinder supports 216. The cylinders 218 contain a piston 221 and a coil or helical spring 223 placed around the piston rod 212. The spring 223 is trapped between the piston 221 and the end of the cylinder 218 from which the piston rod 219 extends. Accordingly, when the slip resistant surface 222 is stepped on and held in position by the friction between the ground and the slip resistant surface 222 and with the walker 210 moving forward the piston rod 219 extends compressing the spring 223. Upon stepping off of the slip resistant surface 222 the slip resistant surface will move forward closer to the front wheels 224 as the spring 223 forces the piston 221 to retract further within the cylinder 218.

Slip resistant surface 220 is in a retracted position under the walker 210 with the spring 223 biasing the piston 221 close to the front wheel 224 and in a position ready to be stepped upon once again prior to advancing the walker 210 forward. Accordingly, this function assures that a slip resistant surface 220 or 222 is always in position under a person's foot as they walk advancing the walker 210 forward. This assures that a person always has secure footing even under slippery conditions, such as on ice, snow, or wet surfaces. The slip resistant surfaces 220 and 222 preferably have cleats 234 placed within keyhole openings 236. The cleats 234 provide a sure grip on icy, snowy, or wet surfaces.

Figure 8:
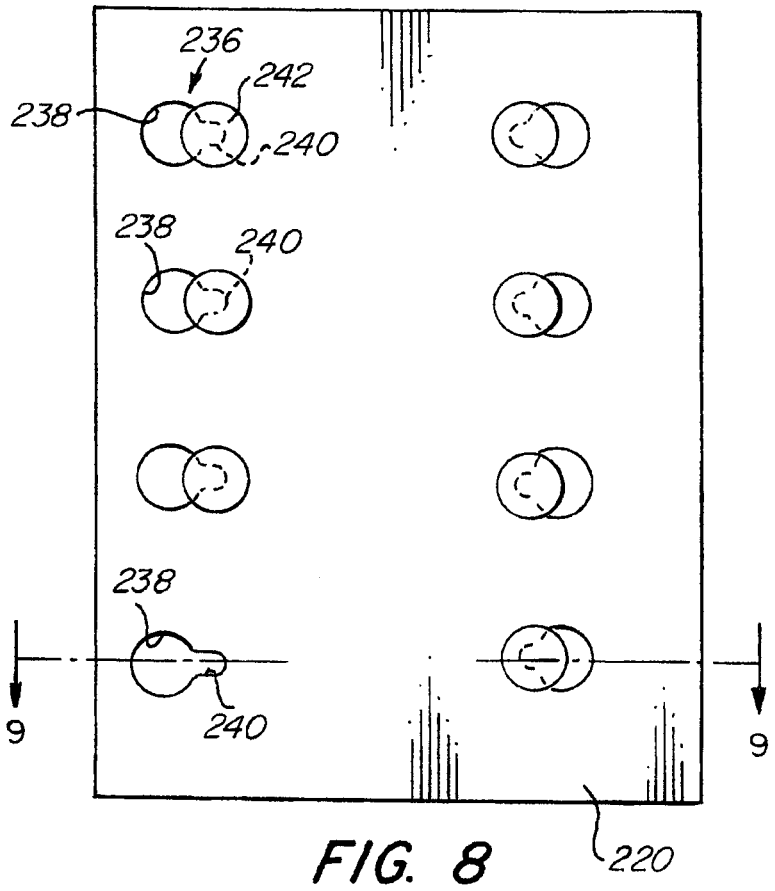
FIG. 8 is a plan view of one of the slip resistant surfaces illustrated in FIGS. 6-7 showing attachment of cleats.
Figure 9:
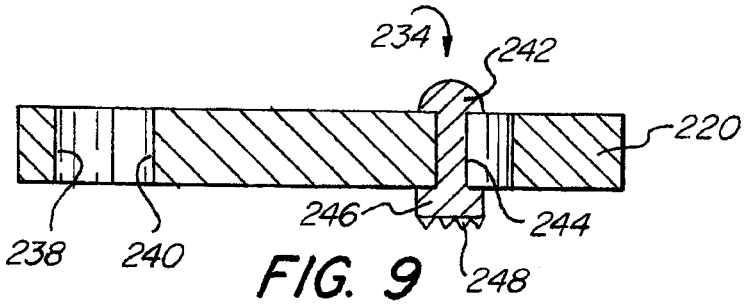
FIG. 9 is a cross section taken along line 9-9 in FIG. 8.

FIGS. 8 and 9 more clearly illustrate the cleats 234 attached to a slip resistant surface 220. As illustrated in FIG. 9, the cleat 234 comprises a cleat head 242, cleat body 244, cleat base 246 with attached cleat spikes 248. The cleat head 242 or cleat base 246 may be placed in and through the circular portion 238 of a cleat opening keyhole 236. The cleat 234 is then slid sideways or longitudinally so that the cleat body 244 fits within the slot portion 240 of the cleat opening keyhole 236. The slot portion 240 may form a friction fit with the cleat body 244 to securely hold the cleats 234 in position. This structure permits the cleats 234 to be easily removable and replaced should the spikes 248 be damaged.

Figure 10A:
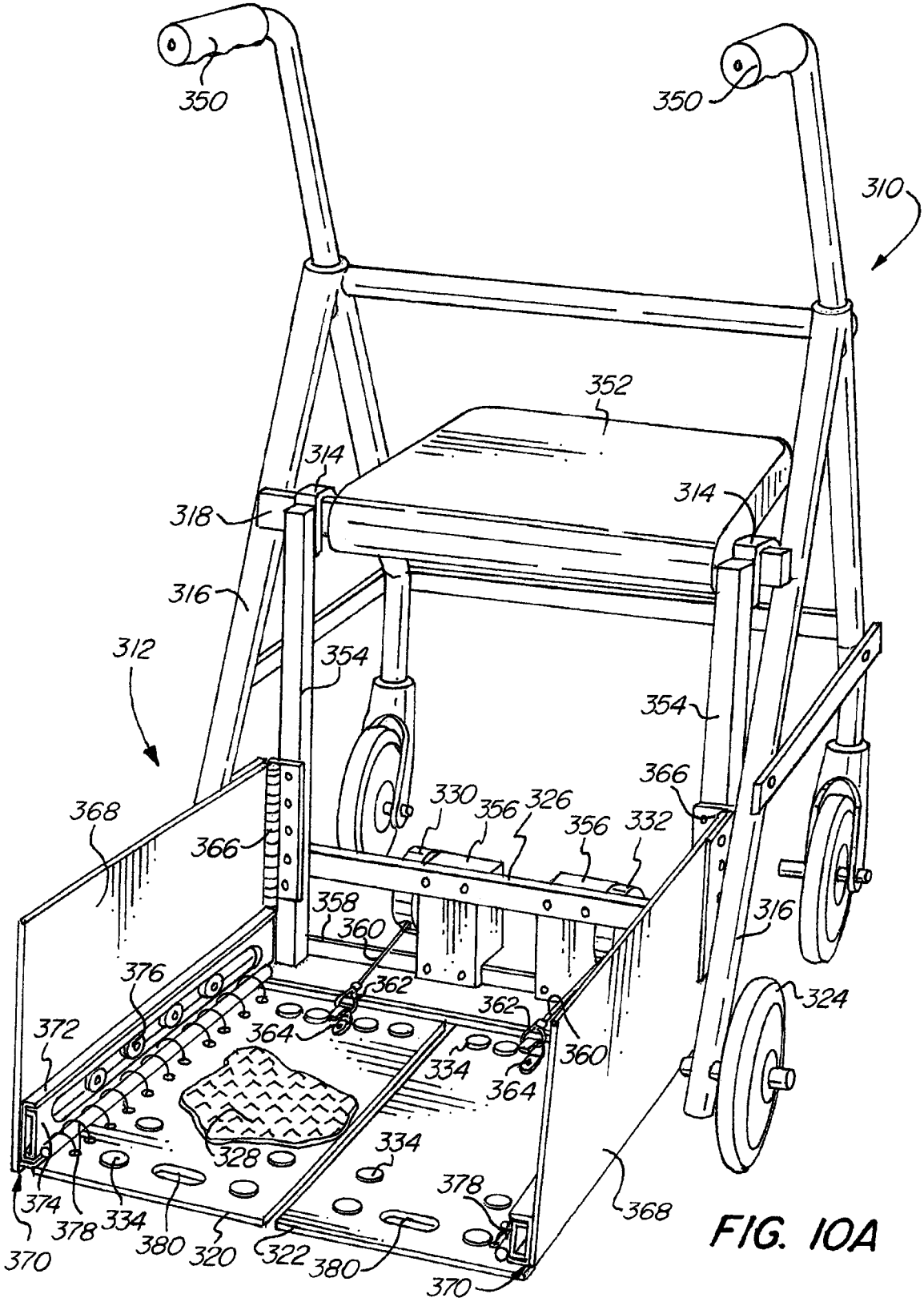
FIG. 10A is a perspective view illustrating an embodiment of the present invention having slip resistant retractable surfaces attachment in an open or ready to use position.
Figure 10B:
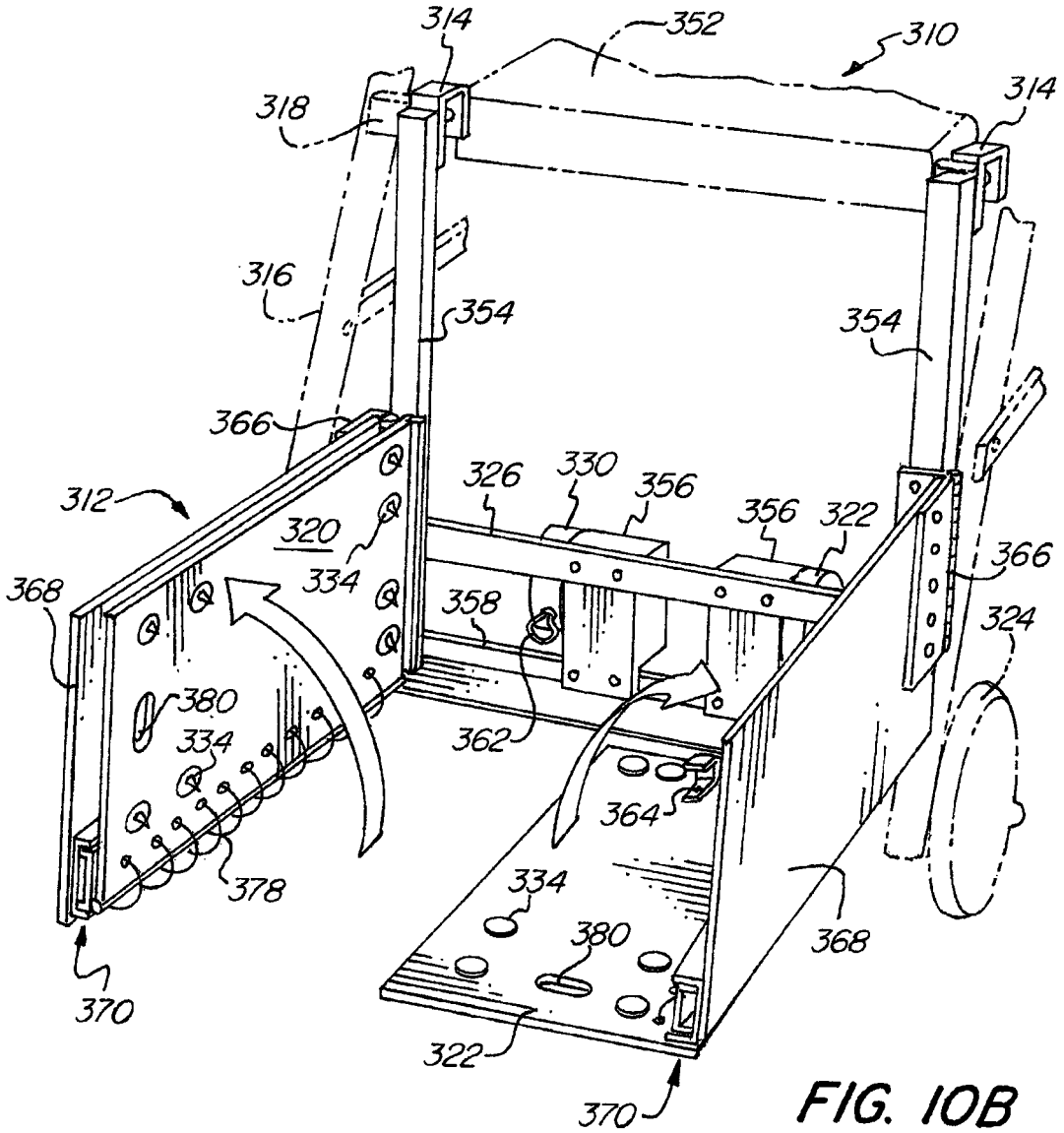
FIG. 10B is a perspective view of the embodiment of the present invention illustrated in FIG. 10A with one slip resistant surface folded up.
Figure 10C:
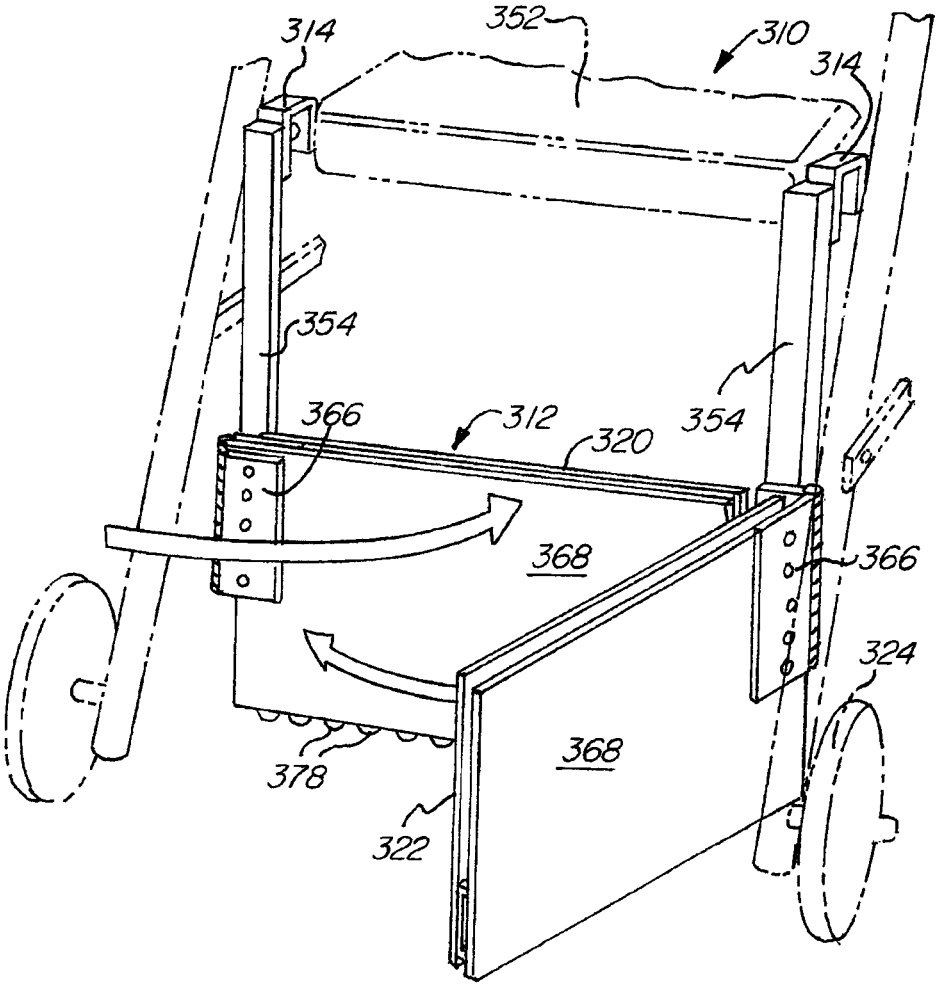
FIG. 10C is a perspective view of the embodiment of the present invention illustrated in FIGS. 10A-B with the slip resistant surfaces folded up and partially closed in a stored position.

FIGS. 10A-C illustrate a preferred embodiment of the present invention in different positions. FIG. 10A-C illustrates the preferred embodiment of the present invention in an open position, a partially folded position, and a partially closed position.

FIG. 10A illustrates the present invention in an open and unfolded operating position ready for use. The slip resistant retractable surface attachment 312 is attached to a walker 310. The walker 310 may have handles 350 and a seat 352. Attachment hooks 314 or other means for attaching are attached to a hook support bar 318 attached to legs 316 of the walker 310. Vertical attachment bars 354 extend from the hooks 314 downward to in upper support bar 326 and a lower support bar 358. The vertical attachment bars are perpendicular to the upper and lower support bars 326 and 358. Attached to the vertical attachment bars 354 are side hinges 366. Attached to the upper and lower support bars 326 and 350 are support boxes 356. A first retractable cord spring 330 is attached to one of the support boxes 356 and a second retractable cord spring 332 is attached to the other support box 356. The retractable cord springs 330 and 332 may be any spring capable of biasing or pulling towards the walker 310, such as a coiled spring. Wound within each of the retractable cord springs 330 and 332 are retractable cords 360. The retractable cord springs 330 and 332 bias the retractable cords 360 inward so that they are normally wound or coiled. Each of the retractable cord springs 330 and 332 has a loop 362 on the distal end. The loops 362 are adapted to selectively connect and disconnect from catches 364. The catches 364 are attached to respective slip resistant surfaces 320 and 322. The slip resistant surfaces 320 and 322 are connected to slides 370 by surface hinges 378. The slides 370 have inner channels 374 connected to the surface hinges 378 and outer channels 372 attached to sides 368. Slide wheels 376 or place between the outer channels 372 and the inner channels 374 so that the inner channels 374 and the outer channels 372 easily move relative to one another. This permits the slip resistant surfaces 320 and 322 to move back and forth relative to the sides 368 and against the bias of the retractable cords 360. Each of the slip resistant surfaces 320 and 322 has removable and replaceable cleats 334 placed therein. The cleats 334 have a button top surface and a spike on the bottom extending through the slip resistant surfaces 320 and 322. The cleats may be of a structure as illustrated in FIGS. 8 and 9. A textured surface or non-slip carpet 328, only a portion of which is illustrated in FIG. 10A on slip resistant surface 320, may be placed on the slip resistant surfaces 320 and 322 to provide additional comfort and traction when a foot is placed thereon. Each of the slip resistant surfaces 320 and 322 may have an opening or hole 380 therein to facilitate lifting of the respective slip resistant surfaces 320 and 322. A handle with a hook, not illustrated, may be provided or attached to the walker 310 or the slip resistant retractable surface attachment 312 to facilitate lifting of the slip resistant surfaces 320 and 322 without having to bend over.

FIG. 10B illustrates the present invention in a partially folded position. The surface hinge 378 permits the slip resistant surface 320 to be folded up adjacent the side 368. The other side slip resistant surface 322 may also be folded upward as illustrated by the arrow. The spikes on the cleats 334 are more clearly illustrated on the bottom surface of the folded up slip resistant surface 320. The cleats 334 may be any commercially available cleat 334 and are easily replaceable. The cleat may also be of a structure and attached to the slip resistant surfaces 320 and 322 as illustrated in FIGS. 8-9.

FIG. 100 illustrates the present invention in a partially closed position. Once the slip resistant surfaces 320 and 322 are folded upward against the respective sides 368 the slip resistant surfaces 320 and 322 and the sides 368 may be closed about respective side hinges 366 so that the slip resistant retractable surface attachment 312 is folded and closed so as to be out of the way. The slip resistant retractable surface attachment 312 can then be conveniently stored on the walker 310 in a folded and closed position and retracted in a compact location that does not extend beyond the wheels 324. The slip resistant retractable surface attachment 312 may also be lift in the folded and closed position or removed if not intended to be used.

FIGS. 10 B-C illustrate how the slip resistant retractable surface attachment 312 can be conveniently folded and closed for storage. When not needed, the loop 362 is unhooked from the catch 364 permitting the slip resistant surfaces 320 and 322 to be folded upward. After the slip resistant surfaces 320 and 322 are folded upward the sides 368 are closed inward. The structure of the embodiment illustrated in FIGS. 10A-C permit the slip resistant retractable surface attachment 312 to be left in position on the walker 310 until needed or removed from the walker 312 and stored.

The operation of the present invention is readily appreciated from FIGS. 10A-C. The slip resistant retractable surface attachment 312 illustrated in FIG. 10A is in a position ready for use. The slip resistant surfaces 320 and 322 are folded down in position with the retractable cords 360 attached to the catches 364 by loops 362. As the walker 310 is moved forward the slip resistant surfaces 320 and 322 are permitted to move back and forth longitudinally along slide 370. When a foot is placed on one of the slip resistant surfaces 320 or 322 the pressure from a foot will hold a respective one of the slip resistant surfaces 320 and 322 in position while the walker 310 is advanced forward. The retractable cord 360 will be pulled out against the bias of the respective retractable cord springs 330 or 332. Upon the lifting of a foot to step forward the pressure on the respective slip resistant surface 320 and 322 is removed permitting the bias force from the retractable cord springs 330 or 332 to pull the respective slip resistant surfaces 320 or 322 forward so as to place it in position for another step. In this way, as the walker 310 is advanced by the user there is always a slip resistant surface 320 or 322 in position to receive the placement of a user's foot. The longitudinal length of the slip resistant surfaces 320 and 322 in combination with the range of motion of the slides 370 should be sufficient so as to accommodate a person's gate or stride so as to assure that each respective slip resistant surface 320 and 322 are in position during the user's natural gate, pace, or stride.

Figure 11A:
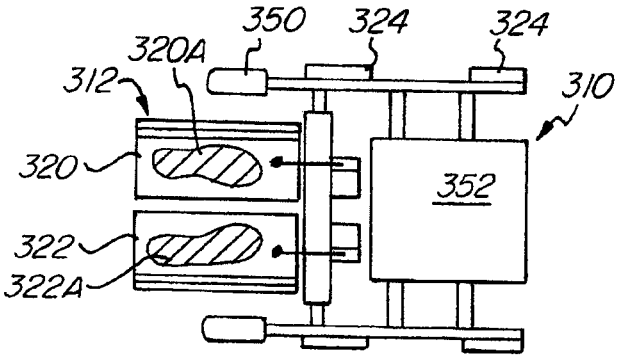
FIGS. 11A-F schematically illustrates the operation of the present invention illustrated in FIGS. 10A-C.
Figure 11B:
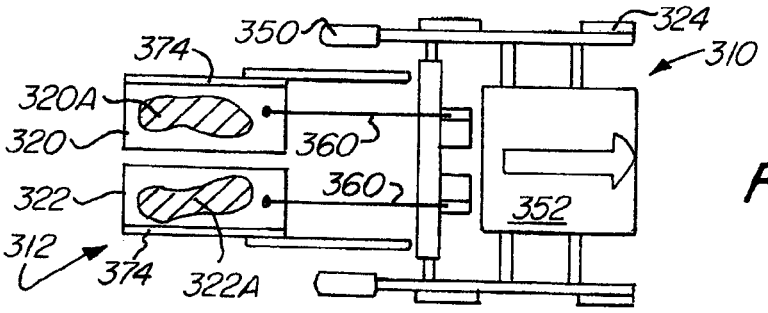
Figure 11C:
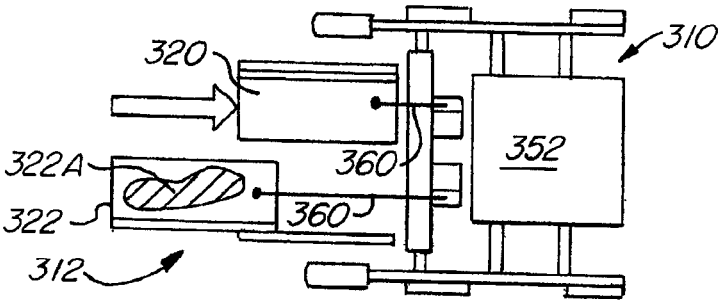
Figure 11D:
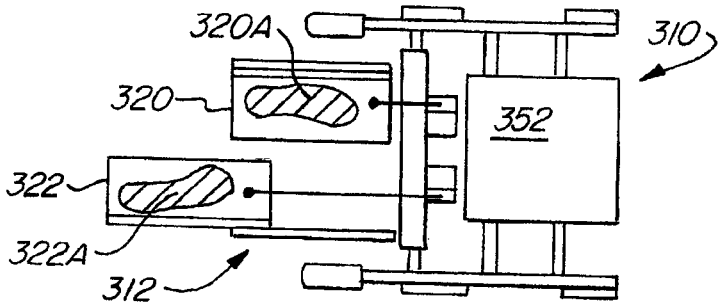
Figure 11E:
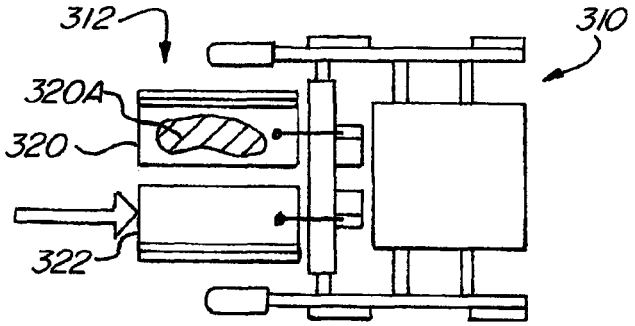
Figure 11F:
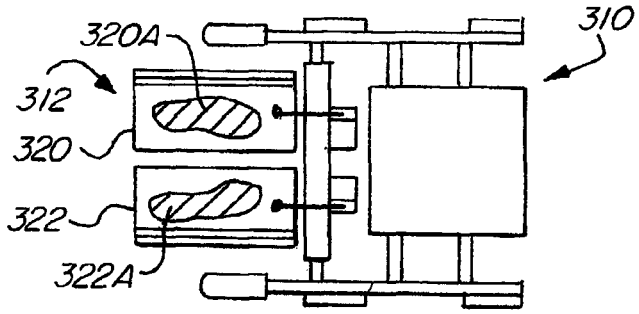

FIGS. 11A-F clearly illustrate the operation of the present invention as a user steps on a respective slip resistant surface 320 or 322. In FIG. 11A a user places their left foot on the slip resistant surface 320 and a right foot on the slip resistant surface 322. The foot image 320A represents pressure applied by the left foot and the foot image 322A represents pressure applied by the right foot. In FIG. 11A a user places their foot pressure on the slip resistant surface 320 and 322 while it is in a retracted position adjacent to the walker 310. FIG. 11B illustrates advancing the walker 310 forward so as to extend the retractable cords 360. FIG. 11C illustrates the removal of a user's left foot from the slip resistant surface 320 permitting the bias of the retractable cord 362 to move the slip resistant surface 320 towards and adjacent the walker 310. FIG. 11D illustrates the advancing and positioning of a user's left foot on the newly positioned slip resistant surface 320 in the taking of a step. FIG. 11E illustrates a use removing their right foot from the slip resistant surface 322 causing the slip resistant surface 322 to move towards and adjacent the walker 310. FIG. 11F illustrates a user moving their right foot into position onto slip resistant surface 322 in the taking of a step. This movement or stepping of the user is repeated as the walker 310 is moved forward. Accordingly, the present invention assures that a slip resistant surface 320 or 322 is positioned under a user's foot as the user advances the walker and steps forward. Therefore, the user is assured that they have secure footing when navigating slippery surfaces, such as water, snow, or ice.

The present invention therefore provides a means whereby any walker can be adapted to accommodate a slip resistant retractable surface attachment 312 that is easily and conveniently attached and removed. In slippery conditions, when needed the slip resistant retractable surface attachment 312 can be attached so as to provide a slip resistant surface 320 or 322 always in position under a person's foot providing secure footing. This provides substantial additional safety, particularly for an elderly person who may have compromised balance or strength.

FIGS. 12A to 19 illustrate another embodiment of the invention. In this embodiment of the present invention a universal or modular type attachment bracket and retractable slip resistant surface and cleat assembly is utilized for providing a retractable slip resistant surface on a variety of different types of mobility aids. The attachment bracket may be modified to attach to different types of mobility aids, such as walkers, wheeled walker's or rollators, and wheelchairs.

Figure 12A:
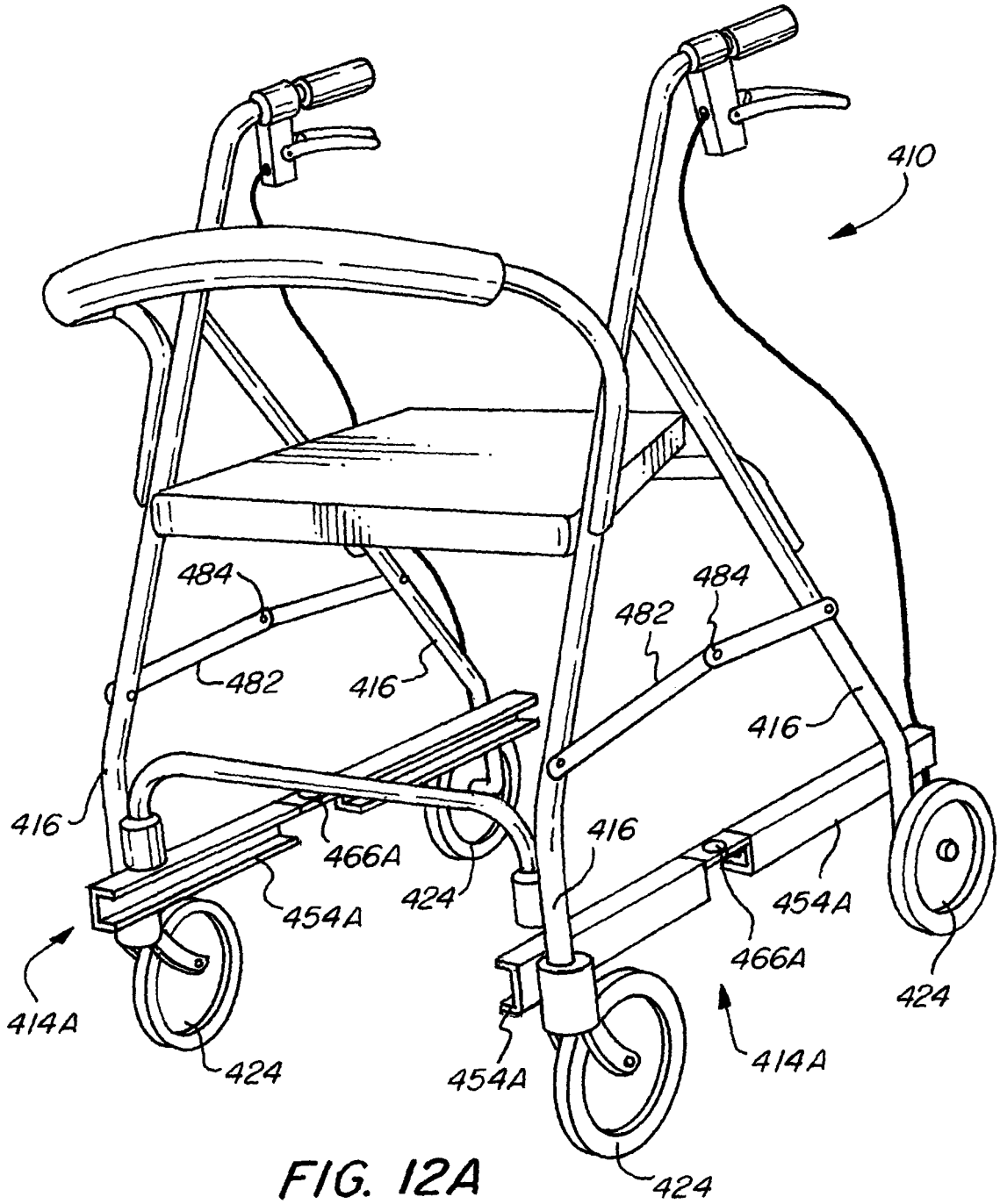
FIG. 12A schematically illustrates an attachment bracket attached to the inside of legs of a mobility aid.
Figure 12B:
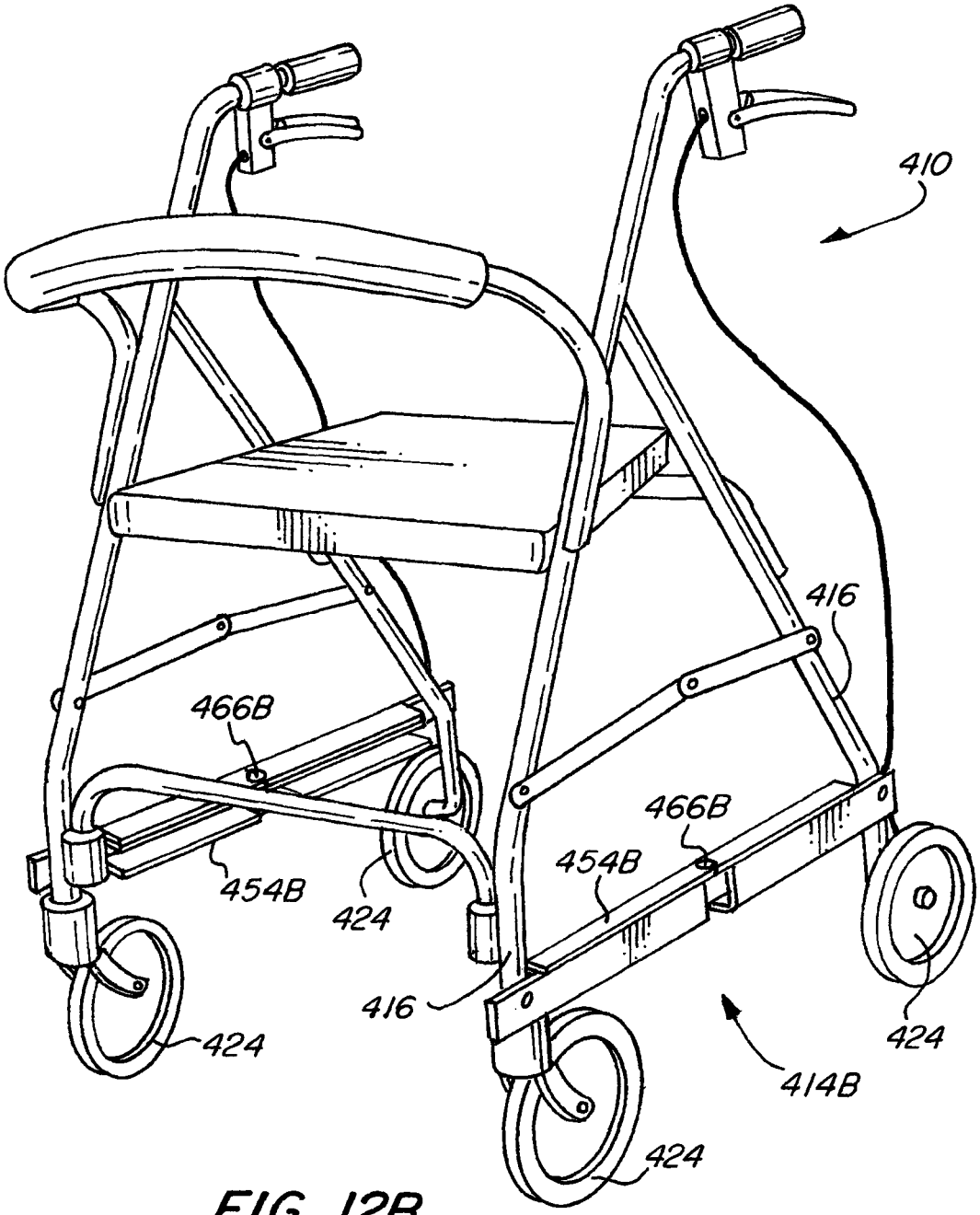
FIG. 12B schematically illustrates an attachment bracket attached between or on the outside of legs of a mobility aid.

FIGS. 12A-B illustrate two different styles of attachment brackets. FIG. 12A illustrates attachment brackets 414A that are mounted on the inside of opposing legs 416 of a mobility aid 410, such as a rolling walker. The mobility aid 410 has wheels 424 on legs 416 and a strut 482 that is pivoted by pivot 484 so that the walking aid 410 can be folded or collapsed for easy storage. The attachment brackets 414A have two sections 454A separated by an intermediate pivot 466A. The pivot 466A is placed in line with and below the pivot 484 permitting the attachment brackets 414A of the mobility aid 410 to be folded or collapsed without removing the attachment brackets 414A. For most wheelchairs the pivot 466A would not be needed. Wheelchairs fold with the sides coming together eliminating the need for the attachment bracket to fold. The attachment brackets 414A are attached to opposing legs 416 and preferably positioned as far apart as possible.

FIG. 12B illustrates attachment brackets 414B that are mounted on the outside of the legs 416 of the mobility aid 410 so as to permit the attachment brackets 414B to be spaced apart as far as possible providing adequate room therebetween to mounted retracting slip resistant surface and cleat assemblies, not illustrated. The attachment brackets 414B have two sections 454B separated by an intermediate pivot 466B.

Figure 13:
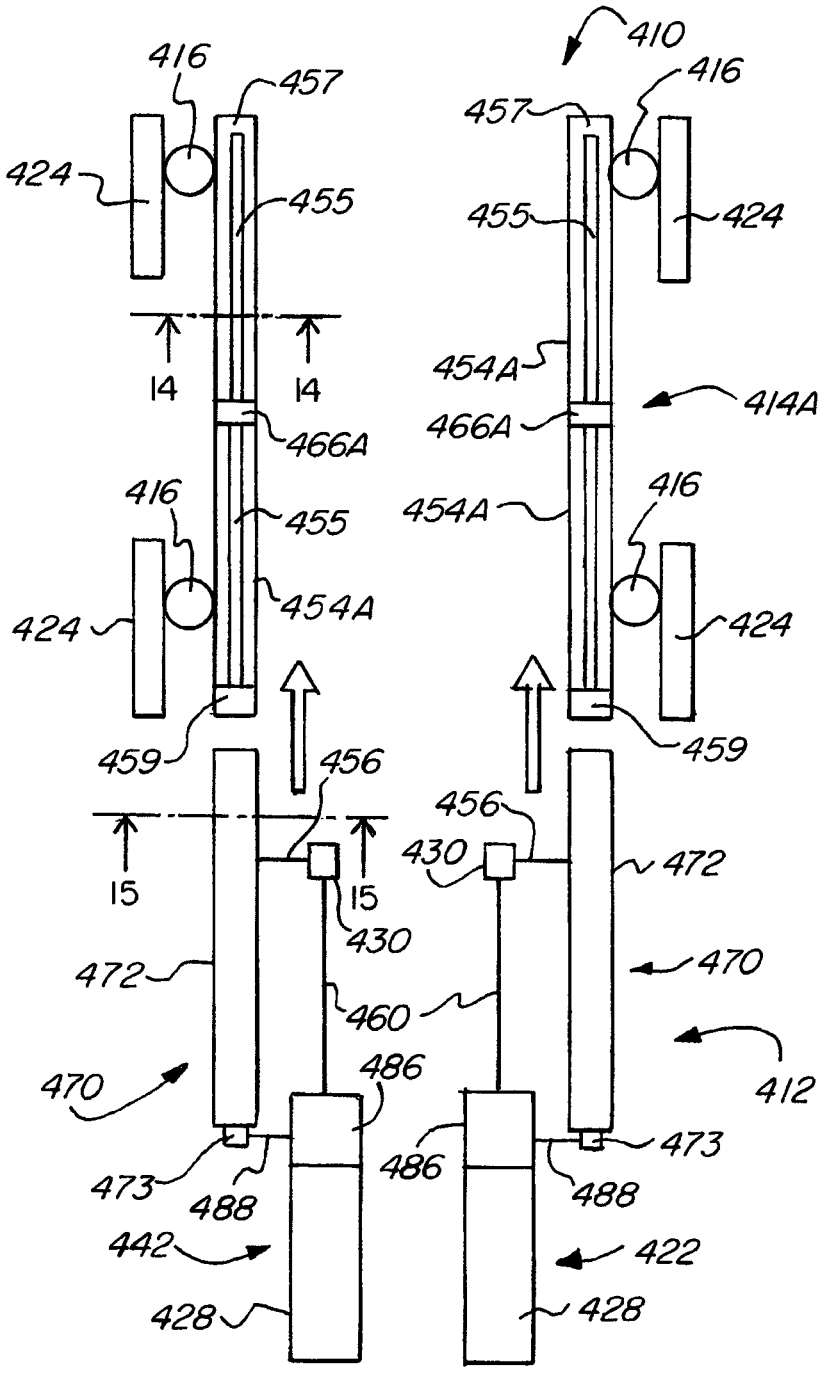
FIG. 13 schematically illustrates a plan view of the present invention comprising the attachment bracket attached to a mobility aid and the retracting slip resistant surface and cleat assembly coupling to the attachment bracket.

FIG. 13 schematically illustrates a plan view of the present invention providing a modular universal system for easily mounting a retracting slip resistant surface and cleat assembly 412 on a walking aid 414. The system of the present invention comprises attachment brackets 414A attached to the mobility aid 410 and a retracting slip resistant surface and cleat assembly 412. The retracting slip resistant surface and cleat assembly 412 comprises a slide assembly 470 and a pad and cleat head assembly 422. The pad and cleat head assembly comprises a cleat head 486 and a pad 428, which preferably has a slip resistant surface.

The slide assembly 470 has an outer slide cover 472 containing an inner slide 473. Attached to the inner slide 473 by connector 488 is the cleat head 486 which is connected to the pad 428. Also connected to the cleat head 486 is a retractable cord 460. Another end of the retractable cord 460 is connected to retracting unit 430. The retracting unit 430 is connected to the slide assembly 470 by a connector 456. The retracting unit 430 biases or retracts the retractable cord 460 to move the pad and cleat head assembly 422 back and forth as desired. The retracting unit 430 may be any mechanical or electric device, such as a spring, elastic member, or motor. If a spring, it may be a tension, volute, coil or helical, or torsion spring.

The attachment brackets 414A attached to the legs 416 of the mobility aid 410 have a channel 455 longitudinally extending therein. On one end of the channel 455 is a channel stop 457. On the other end of the channel 455 is a channel lock 459. The outer slide cover 472 slides onto the attachment bracket 414A and is locked in position with the channel lock 459.

In the system of this embodiment of the present invention the retracting slip resistant surface and cleat assembly 412 can be easily slid onto and slid off of the attachment bracket 414A attached to the mobility aid 410. By using different attachment brackets 414A configurations adapted to be attached to different mobility aids 410 a standard, modular, or universal retracting slip resistant surface and cleat assembly 412 may be used. The retracting slip resistant surface and cleat assembly 412 can then be attached to different attachment brackets 414A adapted to be attached to different mobility aids 410. The retracting slip resistant surface and cleat assembly 412 may also be conveniently and easily removed from the attachment bracket 414A when not in use or as desired. This greatly simplifies and adds flexibility to the application and use of the present invention.

Figure 14:
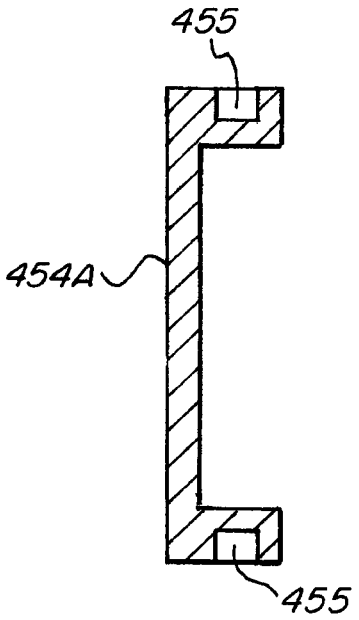
FIG. 14 is a cross section taken along line 14-14 of the attachment bracket.

FIG. 14 is a cross section taken along line 14-14 in FIG. 13 and more clearly illustrates the structure of the attachment bracket 454A. FIG. 14 also more clearly illustrates the channel 455.

Figure 15:
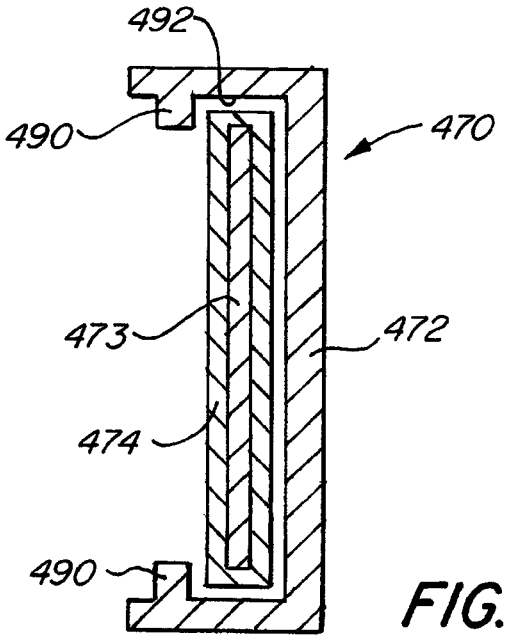
FIG. 15 is a cross section taken along line 15-15 of a slide assembly of the retractable slip resistant surface and cleat assembly.

FIG. 15 is a cross section taken along line 15-15 in FIG. 13 and more clearly illustrates the structure of the slide assembly 470. The slide assembly 470 has an outer slide cover 472 with a slide cavity 492 and a channel key 490. The channel key 490 is adapted to mate with channel 455, illustrated in FIG. 14. Placed within the slide cavity 492 is an intermediate slide 474 and an inner slide 473. The inner slide 473 and the intermediate slide 474 and the outer slide cover 472 freely slide within each other and can be nested and extended, similar to a sliding drawer, so as to extend and retract. Rollers or bearings may be used to facilitate the sliding of the different members relative to each other.

Figure 16:
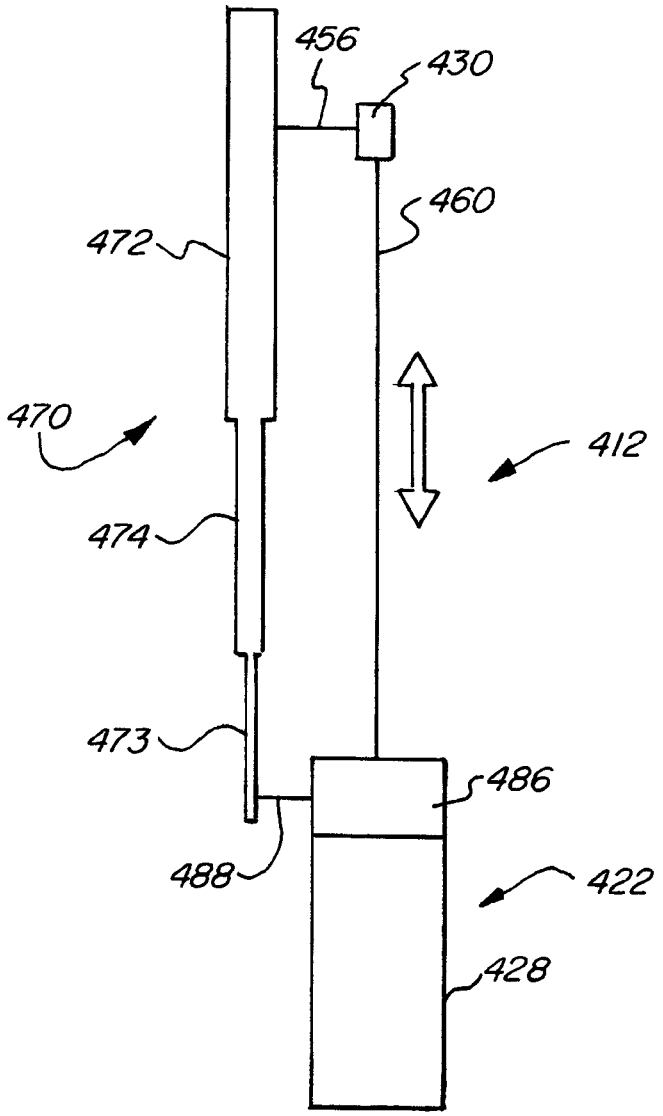
FIG. 16 schematically illustrates a plan view of one of the retractable slip resistant surface and cleat assemblies.

FIG. 16 schematically illustrates the operation of one side of the retracting slip resistant surface and cleat assembly 412 comprising the pad and cleat head assembly 422 and the slide assembly 470. The slide assembly 470 may be extended and retracted by relative movement of the outer slide cover 472, the intermediate slide 474, and the inner slide 473. This permits the pad and cleat head assembly 422 to be moved toward and away from the retracting unit 430. The retracting unit 430 biases the pad and cleat head assembly 422 towards the retracting unit 430 due to the attachment of the retractable cord 460. The slide assembly 470 positions and helps to stabilize the pad and cleat head assembly 422. Accordingly, the pad and cleat head assembly 422 is moved backward and forward to be positioned under a user's feet as the user moves forward.

Figure 17:
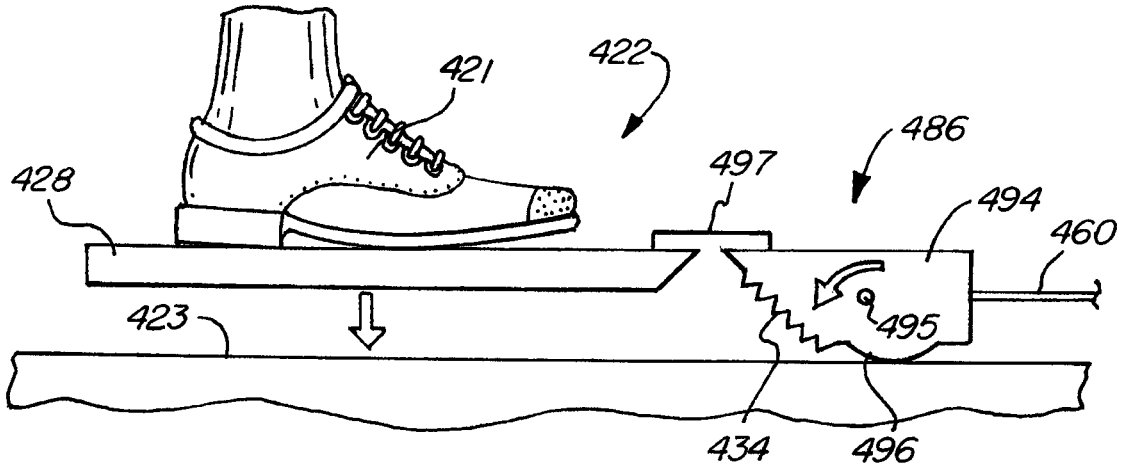
FIG. 17 schematically illustrates an elevational view of a slip resistant surface and cleat head.
Figure 18:
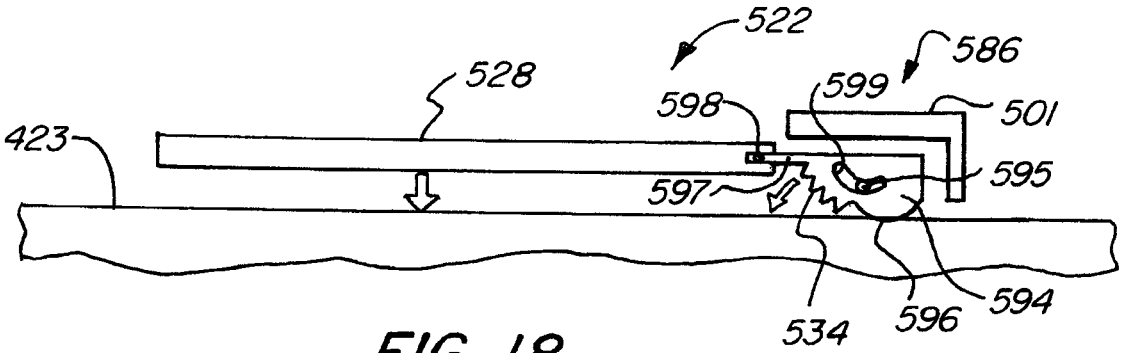
FIG. 18 schematically illustrates an elevational view of another embodiment of a slip resistant surface and cleat head.
Figure 19:
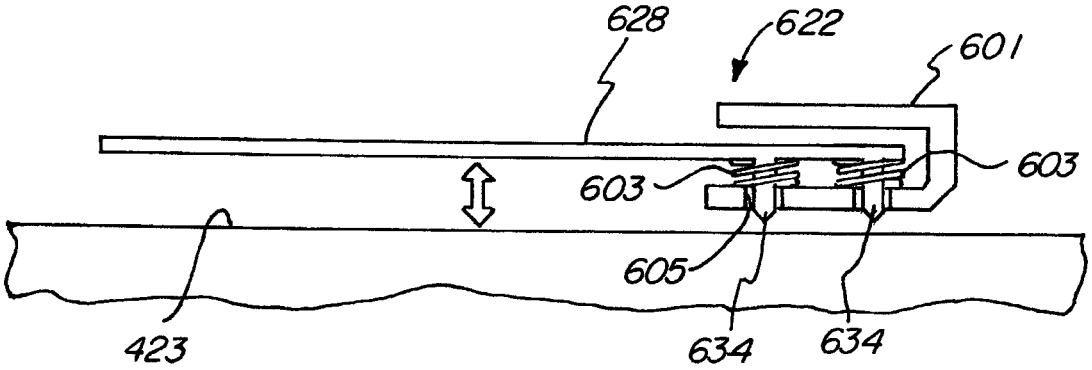
FIG. 19 schematically illustrates an elevation a view of yet another embodiment of the slip resistant surface and cleat head.

FIG. 17-19 schematically illustrates in more detail different embodiments of a pad and cleat head assembly of the present invention. FIG. 17 schematically illustrates a pad and cleat head assembly 422 placed adjacent the ground 423. The pad 428 is coupled to a cleat head 486 by link 497. The cleat head 486 pivots on pivot 495 and rides on the ground with curved contact surface 496. On an angled surface of the cleat head 486 are placed a plurality of cleats 434. The cleats 434 may be replaceable and attached to the cleat head 486 by any conventional attachment mechanism, such as threads, slots, releasable adhesive, screws or other equivalent means. In operation, when foot 421 of a user applies pressure to the pad 428, the link attached to the angled portion of the cleat head 486 causes the cleat head 486 to rotate downward resulting in the cleats 434 securely engaging or embedding in the ground 423 so as to securely hold the pad 428 in place so as to provide secure footing to the user. Upon the user raising their foot 421 so as to move forward the bias from the retractable cord 460 attached to the cleat body 494 causes the cleat body 494 to rotate disengaging the cleats 434 from the ground 423 permitting the pad and cleat head assembly 422 to slide forward. Accordingly, due to the rotating cleat body 494 of the cleat head 486 the cleats 434 are selectively engaging and disengaging cleats.

FIG. 18 schematically illustrates another embodiment of a pad and cleat head assembly 522. A pad 528 is coupled to a cleat head 586 by a link 597 pivotally attached to the pad 528. A cleat body 594 has a pin 595 placed within a slot 599 guiding the rotation of the cleat body 594. The cleat body 594 has a curved contact surface 596 contacting the ground 423 when rotated. Upon pressure being applied to the pad 528 by the user's foot the cleat body 594 is rotated causing the cleats 534 held on a curved surface of the cleat body 594 to be move downward into engagement with the ground 423. Upon the user raising their foot releasing pressure from the pad 528 the bias from a retractable cord, not illustrated, causes the cleat body 594 to rotate disengaging the cleats 534 from the ground 423 permitting the pad and cleat head assembly 522 to move forward. A cleat head housing 501 may be placed around the cleat head 586.

FIG. 19 schematically illustrates another embodiment of a pad and cleat head assembly 622. In this embodiment the pad 628 is directly attached to a plurality of cleats 634 extending through holes 605 within a cleat head housing 601. The cleats 634 are biased upward away from holes 605 by springs 603. When the user's foot applies pressure to the pad 628 the cleats 634 are forced downward into the ground 423. When the user raises their foot the springs 603 bias the pad 628 and attached cleats 634 upward disengaging the cleats 634 from the ground. This permits the bias from the retractable cord, not illustrated, to move the pad and cleat head assembly 622 forward into another position.

This embodiment of the present invention permits the invention to be used with a variety of mobility aids. Once an attachment bracket is fitted and attached to a mobility aid a standard or modular retracting slip resistant surface and cleat assembly can be easily attached for use and removed for transportation or storage.

FIGS. 20 to 23 illustrate another embodiment of the present invention. In this embodiment of the present invention a retractable slip resistant surface attachment for a mobility aid has a slip resistant surface positioning adjustment. In this embedment the slip resistant surface may be adjusted towards or away from the mobility aid depending upon the stride of the user.

Figure 20:
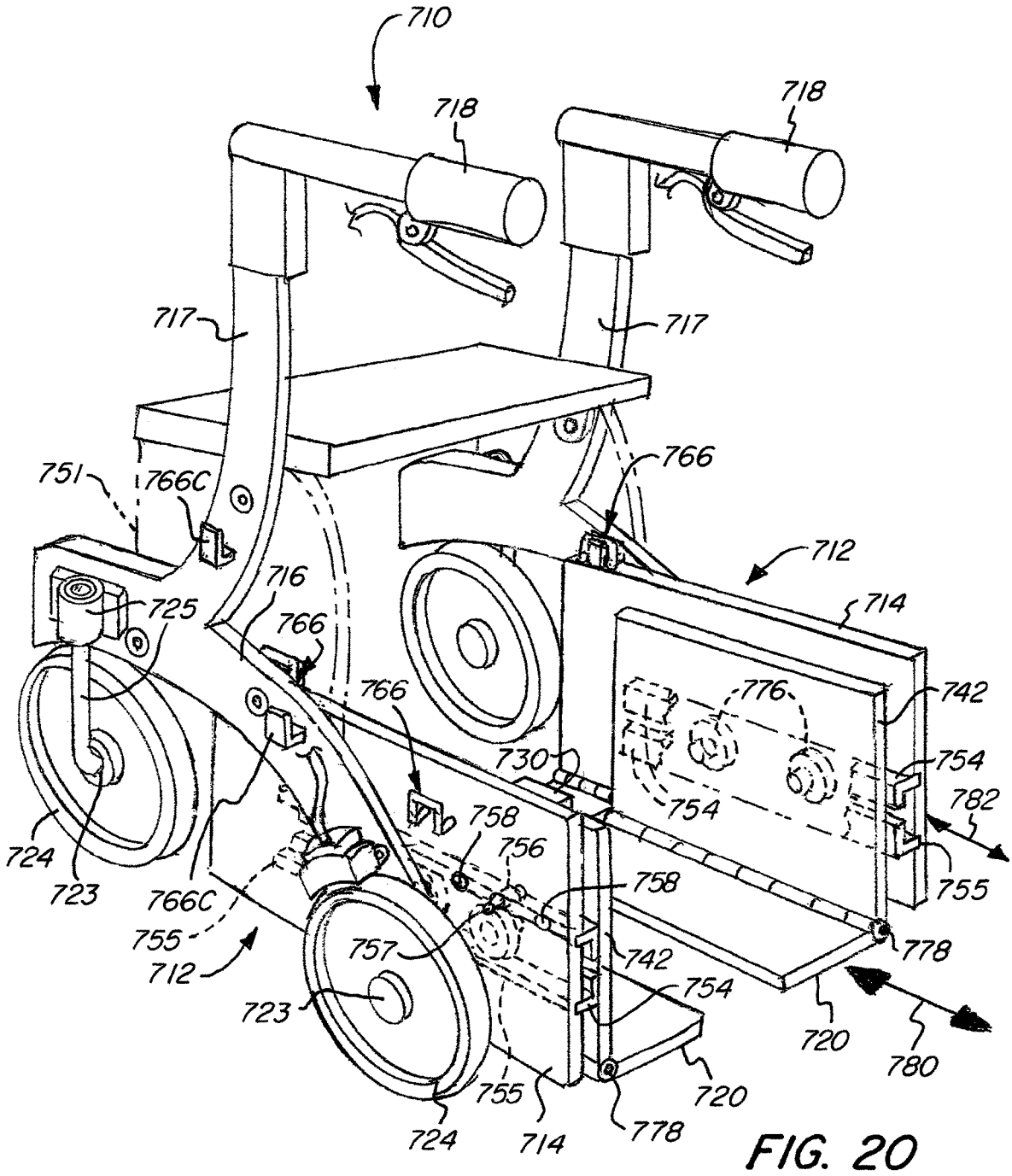
FIG. 20 is a perspective view schematically illustrating another embedment of the present invention that provides lateral adjustment.

FIG. 20 is a perspective view of the retractable slip resistant surface attachment 712 attached to the mobility aid 710. The mobility aid 710 has a frame 717 with attached handles 718 and legs 716. Wheels 724 are attached to legs 716 with an axle 723. Two of the wheels 724 are attached to the front by a wheel swivel 725. The wheel swivel 725 permits the front wheels to rotate three hundred and sixty degrees providing easy mobility and turning. A seat 752 may be placed between the frames 717. Storage 751, shown in phantom or dashed lines, may be positioned under the seat 752.

The retractable slip resistant surface attachments 712 are removably attached to the legs 716 by attachment means 766 when in use. The attachment panels 714 of the retractable slip resistant surface attachments 712 are attached to the legs 716 by the attachment means 716. A sliding channel bracket 754 is slidable placed in channel bracket slots 755 formed in the attachment panels 714. This permits the sliding channel bracket 754 to be positioned longitudinally at any location along the channel bracket slots 755. The channel bracket slots 755 may be T-shaped and mate with a complementary T-shaped leg on the sliding channel bracket 754 so as to be held onto the attachment panels 714 and yet permit longitudinal sliding there along. The leg of the channel bracket has a plurality of holes 758 therein spaced along its longitudinal length. There is at least one through hole 756 in the attachment panels 714 that is positioned to correspond or match to the plurality of holes 758 so that when the sliding channel bracket 754 is moved longitudinally within the channel bracket slots 755 a selected one of the plurality of holes 758 will align with the through hole 756. A pin 757 is placed through the through hole and into the selected one of the plurality of holes 758 so that the sliding channel bracket 754 is held in position preventing longitudinal movement.

A slide panel 742 having a plurality of slide wheels 776 attached thereto is connected to a slip resistant surface 720 by hinge 778. The plurality of slide wheels or members 776 are held within sliding channel bracket 754 and are free to move back and forth longitudinally therein. Arrow 780 illustrated the longitudinal back and forth movement of the slip resistant surface when in position for use. When not in use the retractable slip resistant surface attachments 712 may be removed from attachment means 766, and folded with hinge 778 and stored on storage catch 766C.

Figure 21:
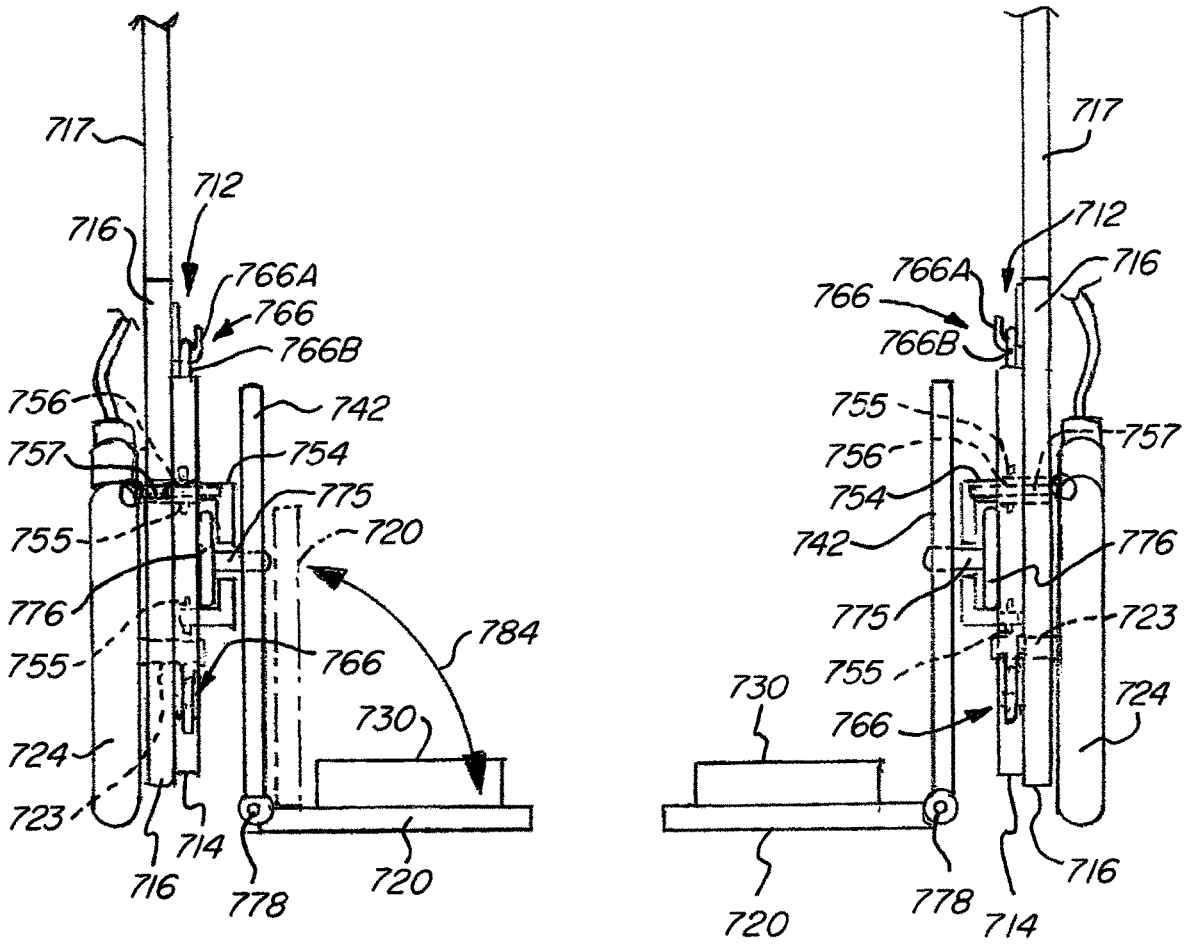
FIG. 21 is an elevational view schematically illustrating the embodiment illustrated in FIG. 20.

FIG. 21 is a rear elevation view of the present invention attached to the legs 716 of a mobility aid in position for use. The attachment means 766 may be comprised of a catch 766A and a corresponding hook 766B. A retraction mechanism 730, such as a spring or elastic member, is connected to the slip resistant surface 720. The retraction mechanism 730 permits the slip resistant surface 720 to be pulled forward towards the retraction mechanism 730 when a user removes foot pressure on the slip resistant surface 720 and to remain stationary when the user applies foot pressure on the slip resistant surface 720 and pushes the mobility aid forward. This assures that the user always has a slip resistant secure footing when walking behind the mobility aid.

The plurality of slide wheels 776 are held within the sliding channel bracket 754. An axle 755 is attached to each of the plurality of slide wheels 776 and the slide panel 742. A stop may be placed at either end of the sliding channel bracket 754 to prevent the plurality of slide wheels 776 from coming out of the ends of the sliding channel bracket 754. The slip resistant surface 720 and the attached slide panel 742 are therefore free to move together back and forth or towards and away from the mobility aid as the user walks behind and advances the mobility aid.

In FIG. 21, the leg of the sliding channel bracket 754 is illustrated in the channel bracket slot 755. Pin 757 is placed through the hole 756 placed in the attachment panel 714 and into the upper leg of the sliding channel bracket 754 to lock the sliding channel bracket 754 into a desired position that is comfortable or appropriate for the user. This permits the slip resistant surfaces 720 to have a range of motion that is moved closer to or further away from the mobility aid so as to accommodate the user's particular stride or movement. Arrow 784 illustrates the movement or folding of the slip resistant surface 720 so that the retractable slip resistant surface attachment 712 may be removed and conveniently stored.

Figure 22:
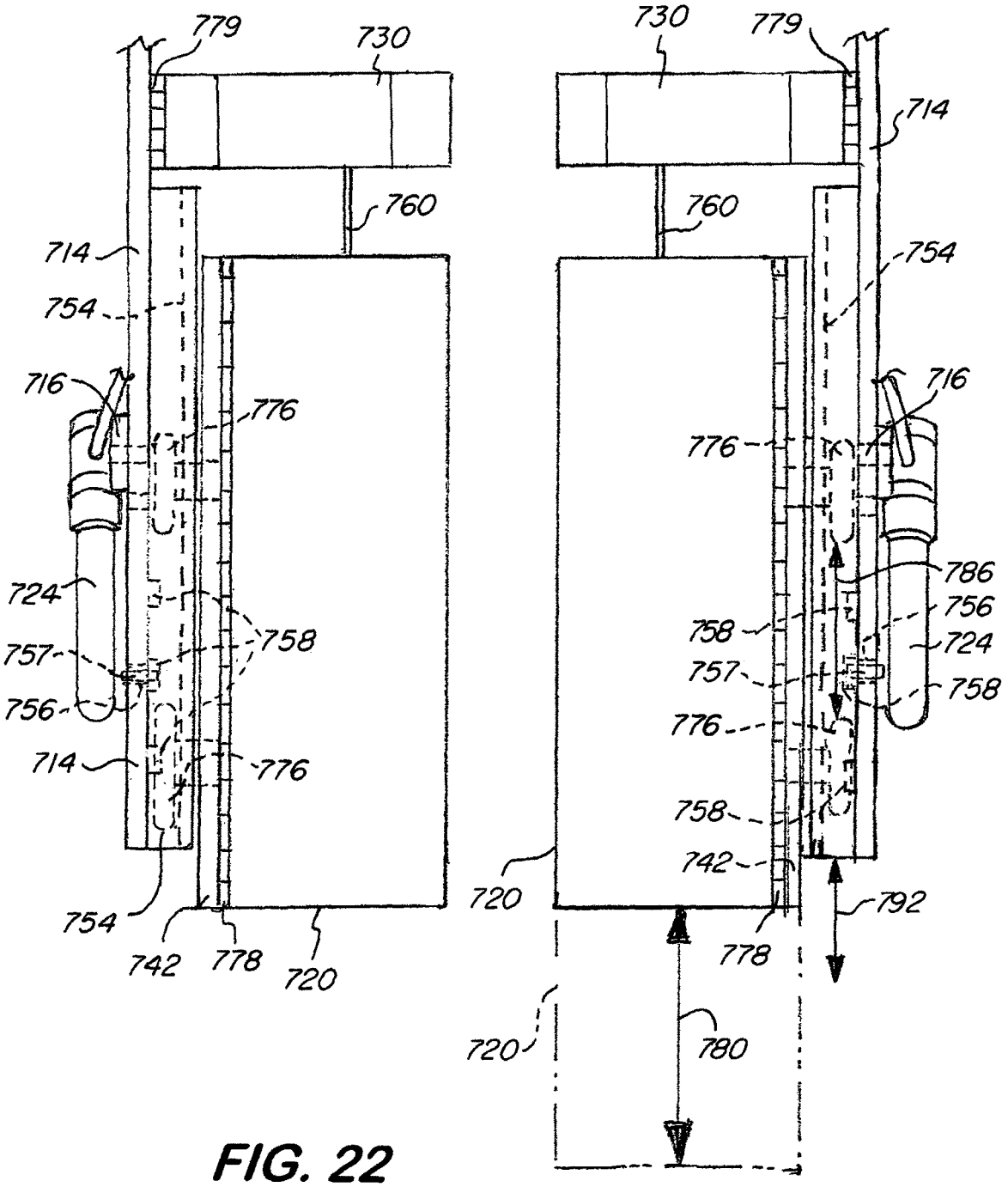
FIG. 22 is a plan view schematically illustrating the embodiment illustrated in FIGS. 20 and 21.

FIG. 22 is a plan view of the present invention attached to the legs 716 of a mobility aid in position for use. FIG. 22 more clearly illustrates the attachment and operation of the retraction mechanism 730. The retraction mechanisms 730 are attached to a respective one of the attachment panels 714 by hinge 779. The retractable cord 760 is attached to the retraction mechanism 730 and the slip resistant surface 720. The retraction mechanism 730, being attached to the attachment panel 714, remains stationary relative to the slip resistant surface 720. Therefore, as the slip resistant surface 720 is stepped on by the user and the mobility aid advances, the slip resistant surface 720 moves rearward away from the retraction mechanism 730 and the retraction cord 760 is extended under tension from the retraction mechanism 730. The slip resistant surface 720 moves with the slide panel 742 with the attached slide wheels 776 moving within the sliding channel bracket 754. Arrow 786 illustrates the movement of the sliding wheels 776 within the sliding channel bracket 754.

FIG. 22 also illustrates the holes 758 placed within a leg of the sliding channel bracket 754 to receive pin 757. Pin 757 extends through the through hole 756 in the attachment panel 714. The pin 757 locks the sliding channel bracket into a fixed longitudinal position. The fixed longitudinal position is set to accommodate the stride or movement of the user.

Figure 23:
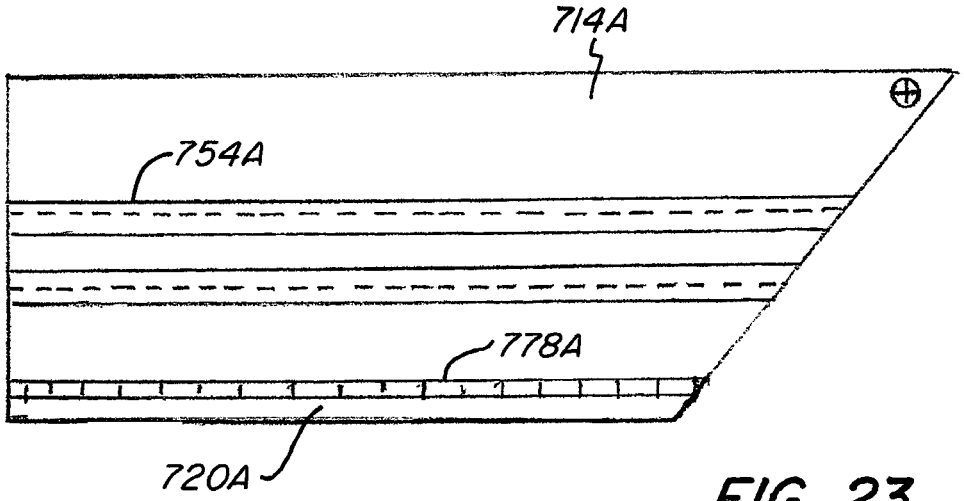
FIG. 23 is an elevational schematic view illustrating an alternate shape for the attachment panel of the embodiment illustrated in FIGS. 20-22.

FIG. 23 illustrates an attachment panel 714A having a trapezoid shape. Also illustrated are the slip resistant surface 720A, the sliding channel bracket 754A and the hinge 778A attaching the slip resistant surface 720A to the attachment panel 714A. FIG. 23 illustrates that the attachment panel 714A may take different shapes as necessary to attach to different mobility aids.

The embodiment of the present invention illustrated in FIGS. 20-23 make possible the easy adjustment or customization of the invention to the user. The slip resistant surfaces 720 can be easily moved forward or backward so as to be positioned for easy walking or use by the user. The slip resistant surfaces 720 may be of the type having cleats as illustrated in FIGS. 7-10C, or the type having cleat head as illustrated in FIGS. 17-19. The adjustable feature of the embodiment illustrated in FIGS. 20-22 is particularly advantageous in adjusting for positioning a user's foot to contact the cleat or cleat head. This is particularly helpful when a user takes a first step forward so as to contact the cleat or cleat head in the initial first step providing secure footing.

Additionally, the retractable slip resistant surface attachment 712 is easily removed and stored on the side of the mobility aid 710 so as to be readily available when needed.

While the present invention has been described with respect to various embodiments, various modifications may be made without departing from the spirit and scope of this invention.

What is claimed is:

1. An attachment to a mobility aid for improving stability of a user on a slippery surface and adjusting to accommodate the user comprising:

an attachment panel attached to each opposing side of the mobility aid;

a sliding bracket slidably attached and selectively positioned and fixed longitudinally to each of said attachment panels;

a slide panel attached to each of said sliding brackets, said slide panel freely moving relative to said sliding bracket;

a slip resistant surface attached to each of said slide panels; and a retraction mechanism fixed to each of said attachment panels and attached to said slip resistant surface, whereby said slide panel and said slip resistant surfaces are capable being adjusted closer to and further away from the mobility aid so as to accommodate a stride of the user.

2. The attachment to a mobility aid for improving stability of a user on a slippery surface and adjusting to accommodate the user as in claim 1 wherein:

said retraction mechanism comprises a spring and retractable cord.

3. The attachment to a mobility aid for improving stability of a user on a slippery surface and adjusting to accommodate the user as in claim 1 further comprising:

a hinge attaching said slide panel to said slip resistant surface.

4. The attachment to a mobility aid for improving stability of a user on a slippery surface and adjusting to accommodate the user as in claim 1 further comprising:

a channel bracket slot formed in said slide panel; and a leg of said sliding bracket held within said channel bracket slot.

5. The attachment to a mobility aid for improving stability of a user on a slippery surface and adjusting to accommodate the user as in claim 1 further comprising:

a plurality of sliding wheels attached to said slide panel and held in said sliding channel bracket.

6. The attachment to a mobility aid for improving stability of a user on a slippery surface and adjusting to accommodate the user as in claim 1 further comprising:

fixing means, coupled to said attachment panel and said sliding channel bracket, for fixing said sliding channel bracket in a position relative to said attachment panel.

7. The attachment to a mobility aid for improving stability of a user on a slippery surface and adjusting to accommodate the user as in claim 1 further comprising:

attachment means, coupled to said retractable slip resistant surface attachment and the mobility aid, for removably attaching said retractable slip resistant surface attachment to the mobility aid.

8. The attachment to a mobility aid for improving stability of a user on a slippery surface and adjusting to accommodate the user as in claim 7 wherein:

said attachment means comprises use attachment means for removably attaching said retractable slip resistant surface attachment to the mobility aid in a use position under the mobility aid.

9. The attachment to a mobility aid for improving stability of a user on a slippery surface and adjusting to accommodate the user as in claim 7 wherein:

said attachment means comprises storage attachment means for removably attaching said retractable slip resistant surface attachment to the mobility aid in a storage position on a side of the mobility aid.

10. An attachment to a mobility aid for improving stability of a user on a slippery surface and adjusting to accommodate a stride of the user comprising:

a catch placed on each opposing side of the mobility aid;

an attachment panel removably attached to each opposing side of the mobility aid with a hook coupled to said catch;

a channel bracket slot formed in each of said attachment panels, said channel bracket slot extending longitudinally;

a sliding bracket having a leg slidably attached to each of said channel bracket slots;

a slide panel positioned adjacent each of said sliding brackets;

a sliding member attached to each of said slide panels and captured within each of said sliding brackets, said slide panel freely moving relative to said sliding bracket;

a slip resistant surface placed adjacent each of said slide panels;

a hinge attaching each of said slip resistant surfaces to a respective one of said slide panels; and a retraction mechanism fixed to each of said attachment panels; and a cord attached between each of said retraction mechanisms and said slip resistant surfaces, whereby said slide panel and said slip resistant surfaces are capable being adjusted closer to and further away from the mobility aid so as to accommodate a stride of the user.

* * * * *